US011614707B2

(12) United States Patent
Togu et al.

(10) Patent No.: US 11,614,707 B2
(45) Date of Patent: Mar. 28, 2023

(54) DETACHABLE CONTAINER AND CONTAINER MOUNTING APPARATUS

(71) Applicant: FUJIFILM Business Innovation Corp., Tokyo (JP)

(72) Inventors: Iori Togu, Kanagawa (JP); Kiyohito Horii, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/333,091

(22) Filed: May 28, 2021

(65) Prior Publication Data

US 2022/0137546 A1 May 5, 2022

(30) Foreign Application Priority Data

Oct. 30, 2020 (JP) ..... JP2020-182833

(51) Int. Cl.
*G03G 21/16* (2006.01)
*G03G 21/12* (2006.01)

(52) U.S. Cl.
CPC ..... *G03G 21/1647* (2013.01); *G03G 21/12* (2013.01); *G03G 2221/163* (2013.01); *G03G 2221/1654* (2013.01)

(58) Field of Classification Search
CPC ..... G03G 21/1647; G03G 21/12; G03G 2221/163; G03G 2221/1654
See application file for complete search history.

(56) References Cited

U.S. PATENT DOCUMENTS

2009/0010677 A1* 1/2009 Yang ..... G03G 21/1647 399/110
2012/0186952 A1 7/2012 Hatano et al.

FOREIGN PATENT DOCUMENTS

JP 2012-146472 A 8/2012

* cited by examiner

*Primary Examiner* — Sandra Brase
(74) *Attorney, Agent, or Firm* — Sughrue Mion, PLLC

(57) ABSTRACT

A detachable container includes: a container body configured to be detachably attached to a receiving portion of an apparatus housing; a joining unit provided on the container body, the joining unit being configured to be rotatably joined with a joined unit provided on the apparatus housing; an operation unit having a rotation center coaxial with the joining unit, the operation unit being configured to perform a rotational operation for the joining unit; and a restraint unit provided coaxially with the rotation center of the operation unit, the restraint unit being configured to, when the container body is attached to the receiving portion of the apparatus housing, allow a rotation of the operation unit, and when the container body is not attached, to restrain the rotation of the operation unit.

20 Claims, 22 Drawing Sheets

AT TIME OF RESTRAINT

AT TIME OF RESTRAINT RELEASE

AT TIME OF LOCKING

AT TIME OF UNLOCKING

DETACHABLE CONTAINER AND CONTAINER MOUNTING APPARATUS

CROSS-REFERENCE TO RELATED APPLICATIONS

This application is based on and claims priority under 35 USC 119 from Japanese Patent Application No. 2020-182833 filed Oct. 30, 2020.

BACKGROUND

(i) Technical Field

The present disclosure relates to a detachable container and a container mounting apparatus.

(ii) Related Art

In the related art, as a detachable container of the type, one described in JP-A2012-146472 (see "the detailed description of embodiments" section and FIG. 5) is known.

JP-A-2012-146472 discloses an opening and closing device with a lock mechanism in which a handle that is driven to open and close a movable contact of the opening and closing device is integrally formed on the lateral side thereof with an eave-shaped overhang having a notch formed therein, a lock lever that is elastically repelled upward by a spring is provided at a position adjacent to the overhang, and a lock protrusion is provided at a position on the handle side of the lock lever to lock a handle operation in the other side direction by engaging with the notch in the overhang when the handle is at one side position and to allow the handle operation by coming into contact with the lower surface of the overhang when the handle is at the other side position.

SUMMARY

Aspects of non-limiting embodiments of the present disclosure relate to (i) stably securing connectivity between a restraint unit and a joined unit provided on an apparatus housing as compared with a configuration in which the restraint unit is offset from a rotation center of an operation unit and (ii) preventing erroneous restraint and restraint release by the restraint unit.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a detachable container including: a container body configured to be detachably attached to a receiving portion of an apparatus housing; a joining unit provided on the container body, the joining unit being configured to be rotatably joined with a joined unit provided on the apparatus housing; an operation unit having a rotation center coaxial with the joining unit, the operation unit being configured to perform a rotational operation for the joining unit; and a restraint unit provided coaxially with the rotation center of the operation unit, the restraint unit being configured to, when the container body is attached to the receiving portion of the apparatus housing, allow a rotation of the operation unit, and when the container body is not attached, to restrain the rotation of the operation unit.

BRIEF DESCRIPTION OF THE DRAWINGS

Exemplary embodiment(s) of the present disclosure will be described in detail based on the following figures, wherein.

DETAILED DESCRIPTION

Outline of Exemplary Embodiment

Figure 1A:
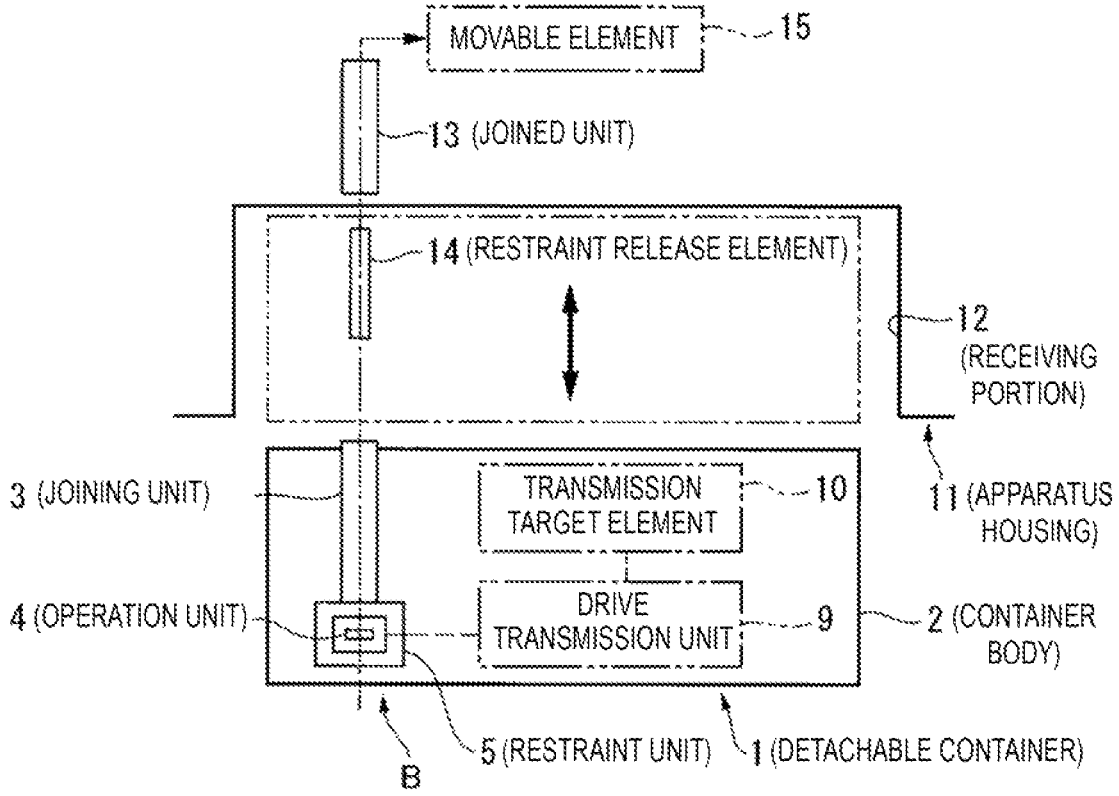
FIG. 1A is a view illustrating an outline of a container mounting apparatus including a detachable container to which an exemplary embodiment of the present disclosure is applied.

FIG. 1A is a view illustrating an outline of a container mounting apparatus including a detachable container to which an exemplary embodiment of the present disclosure is applied.

In FIG. 1A, the container mounting apparatus includes an apparatus housing 11 and a detachable container 1 detachably attached to a receiving portion 12 of the apparatus housing 11.

In this example, the detachable container 1 includes a container body 2 that is detachably attached to the receiving portion 12 of the apparatus housing 11, a joining unit 3 provided on the container body 2, the joining unit 3 that is rotatably joined with a joined unit 13 provided on the apparatus housing 11, the operation unit 4 having a rotation center coaxial with the joining unit 3, the operation unit 4 that performs a rotational operation for the joining unit 3; and a restraint unit 5 provided coaxially with the rotation center of the operation unit 4, the restraint unit 5 that, when the container body 2 is attached in the receiving portion 12 of the apparatus housing 11, allows a rotation of the operation unit 4, and when the container body 2 is not attached, to restrain the rotation of the operation unit 4.

In this technique, the detachable container 1 is not limited to a container that accommodates powder such as a waste toner. Examples of the detachable container 1 broadly include detachable containers that accommodates liquid-phase and/or solid-phase objects.

Further, examples of the joining unit 3 may broadly include any unit that may be joined to the joined unit 13 provided on the apparatus housing 11. For example, the joining unit 3 is a coupling (shaft coupling) that may be joined in a predetermined positional relationship. Alternatively, others such as gears, D-cut shafts, and D-cut bearings may be appropriately selected as the joining unit 3 if they are capable of transmitting driving by contact between components.

Here, the joined unit 13 may be appropriately selected. The joined unit 13 may constitute a drive input unit of a forward and backward movement mechanism that moves a movable element 15 equipped in the container mounting apparatus forward and backward.

Further, examples of the operation unit 4 broadly include a rod-shaped unit and a disc-shaped unit if they rotate about the rotation center thereof as a fulcrum.

Furthermore, the restraint unit 5 needs to be provided coaxially with the rotation center of the operation unit 4, in addition to exhibiting a basic function of allowing the rotation of the operation unit 4 when the container body 2 is attached and restraining the rotation of the operation unit 4 when the container body 2 is not attached. The reason why the restraint unit 5 needs to have the above configuration is that the joined state between the joining unit 3 and the joined unit 13 at the time of restraint release by the restraint unit 5 is easily achieved.

Therefore, this example excludes a mode in which the restraint unit is arranged offset from the rotation center of the operation unit 4. In such a restraint unit, even if the relative positions of the joining unit 3 and the joined unit 13 are slightly offset from each other due to factors such as component tolerances or postures or variations in the positioning of the container body 2, an operation by the operation unit 4 becomes possible when the restraint release position of the restraint unit is accidentally realized, which may cause erroneous restraint release by the operation unit 4.

Next, examples of the detachable container 1 according to the present exemplary embodiment will be described.

Figure 1B:
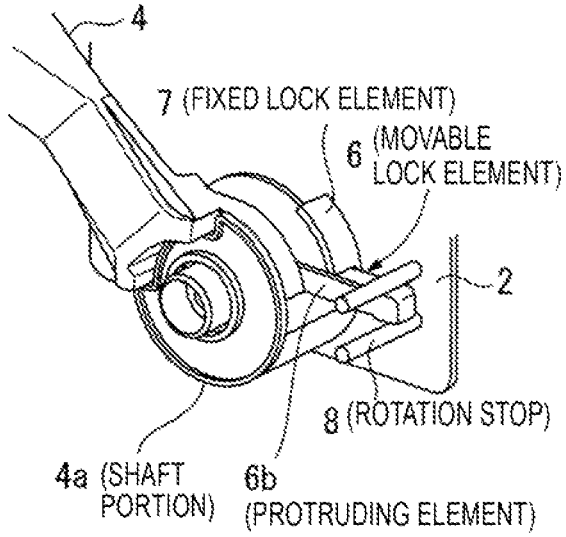
FIG. 1B is a view illustrating a restrained state of the detachable container illustrated in portion B of FIG. 1A.
Figure 1C:
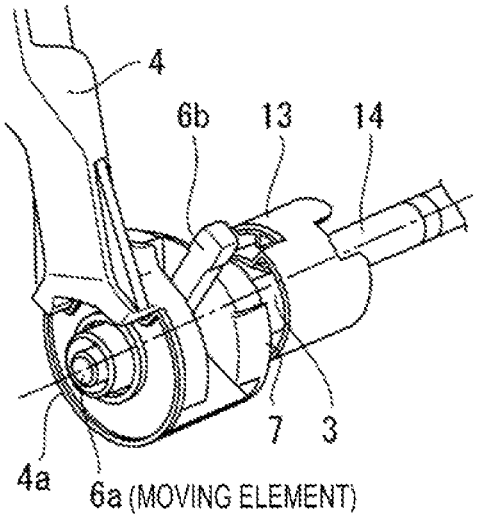
FIG. 1C is a view illustrating a restraint released state of the detachable container illustrated in the portion B of FIG. 1A.

First, as illustrated in FIGS. 1B and 1C, the restraint unit 5 may include a movable lock element 6 that moves from the restraint position where the movable lock element 6 restrains the operation unit 4 to the restraint release position where the movable lock element 6 releases the operation unit 4 from the restrained state, and a fixed lock element 7 that restrains the operation unit 4 in conjunction with the movable lock element 6 at the restraint position.

In one example, when the container body 2 is attached, the restraint unit 5 may move the movable lock element 6 from the restraint position to the restraint release position in conjunction with a restraint release element 14 provided coaxially with the joining unit 3 or the joined unit 13. In this example, the restraint release element 14 may be appropriately selected regardless of a movement path thereof if the restraint release element 14 moves the movable lock element 6 located at the restraint position to the restraint release position in conjunction with the restraint unit 5.

Further, in another example, the restraint unit 5 may include an urging element (not illustrated in FIGS. 1A to 1C) that urges the movable lock element 6 toward the restraint position. When the container body 2 is not attached, the restraint unit 5 may hold the movable lock element 6 at the restraint position. In this example, when the container body 2 is not attached, the urging element forcibly returns the movable lock element 6 located at the restraint release position to the restraint position.

Further, the movable lock element 6 may move forward and backward along the rotational axis of the operation unit 4 and may be stopped from rotating by a rotation stop 8. In this example, the movable lock element 6 is stopped from rotating and is moved forward and backward along the rotational axis of the operation unit 4. The forward and backward movement of the movable lock element 6 is stabilized.

Further, in one example, the movable lock element 6 may include a moving element 6*a* that moves forward and backward along the rotational axis of the operation unit 4, and a protruding element 6*b* that protrudes in a direction intersecting with a direction in which the moving element 6*a* moves forward and backward. When the movable lock element 6 is located at the restraint position, the protruding element 6*b* may be in contact with the fixed lock element 7. When the movable lock element 6 is located at the restraint release position, the protruding element 6*b* is not in contact with the fixed lock element 7.

Furthermore, in another example, the movable lock element 6 may include a moving element 6*a* that moves forward and backward along the rotational axis of the operation unit 4, and a protruding element 6*b* that protrudes in a direction intersecting with a direction in which the moving element 6*a* moves forward and backward. The protruding element 6*b* may be stopped from rotating by the rotation stop 8. It is noted that while the rotation stop 8 illustrated in FIG. 1B is omitted in FIG. 1C, the protruding element 6*b* is arranged at a position where it remains stopped from rotating by the rotation stop (not illustrated) to enable the rotational operation of the operation unit 4.

Further, as illustrated in FIG. 1A, a drive transmission portion (not illustrated) may be formed on the outer periphery of the joining unit 3 or a shaft portion 4*a* of the operation unit 4. A drive transmission unit 9 may be further provided. The drive transmission unit 9 may transmit a rotational drive force from the drive transmission portion to a transmission target element 10 in conjunction with the rotational operation of the operation unit 4. In this example, the drive transmission portion is provided on the outer periphery of the joining unit 3 or the operation unit 4 and the rotational drive force from the drive transmission portion is transmitted to the transmission target element 10 via the drive transmission unit 9.

Here, the transmission target element 10 may be configured as follows. In one example, the container body 2 may have a connection opening to which a transport unit provided on the apparatus housing 11 is connectable. The transmission target element 10 may include an opening and closing unit (not illustrated) to open and close the connection opening. When the container body 2 is attached, the drive transmission unit 9 opens the opening and closing unit in conjunction with the rotational operation of the operation unit 4. In another example, the transmission target element 10 may include a retaining unit (not illustrated). When the container body 2 is attached, the retaining unit holds the container body 2 inseparably with respect to the receiving portion 12 of the apparatus housing 11. When the container body 2 is attached, the drive transmission unit 9 actuates the retaining unit (not illustrated) in conjunction with the rotational operation of the operation unit 4.

Hereinafter, the present disclosure will be described in more detail with reference to exemplary embodiments illustrated in the accompanying drawings.

First Exemplary Embodiment

Figure 2:
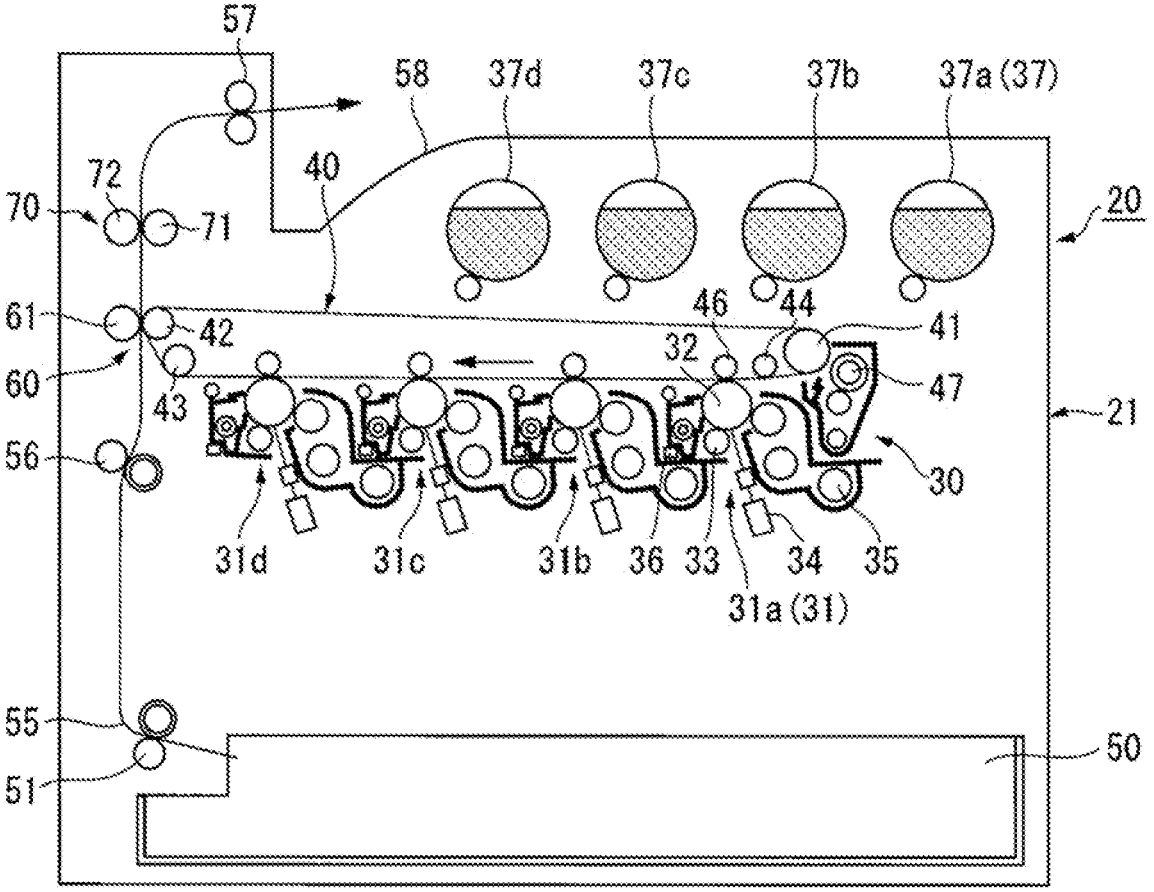
FIG. 2 is a view illustrating an overall configuration of a powder processing apparatus which is an example of the container mounting apparatus according to a first exemplary embodiment.

FIG. 2 illustrates an overall configuration of a powder processing apparatus (an example of the container mounting apparatus) according to a first exemplary embodiment.

Overall Configuration of Powder Processing Apparatus

In FIG. 2, in the powder processing apparatus 20, an image forming engine 30 for forming, for example, an image having multiple color components is mounted in an apparatus housing 21, a sheet supply container 50 (a one-stage configuration of which being illustrated in this example) for supplying a sheet serving as a medium is arranged below the image forming engine 30, and the sheet supplied from the sheet supply container 50 is transported through a transport path 55 extending in a substantially vertical direction. After the image formed by a toner serving as powder in the image forming engine 30 is transferred onto the sheet in a collective transfer device 60, the image transferred onto the sheet is fixed in a fixing device 70, and the sheet on which the image has been completely fixed is discharged to, for example, a sheet discharge tray 58 provided on the top of the apparatus housing 21.

Image Forming Engine

In this example, the image forming engine 30 has, for example, multiple image forming units 31 (specifically, 31*a* to 31*d*) of an electrophotographic type using toners of multiple color components (in this example, yellow (Y), magenta (M), cyan (C), and black (K)). After an image of each color component formed by each image forming unit 31 is primarily transferred to an intermediate transfer body 40, all images on the intermediate transfer body 40 are collectively transferred to the sheet in the collective transfer device 60.

Image Forming Unit

In this example, the image forming unit 31 (31*a* to 31*d*) has, for example, a drum-shaped photoconductor 32, and around the photoconductor 32, a charging device 33 which charges the photoconductor 32, a latent image writing device 34 which forms an electrostatic latent image on the charged photoconductor 32, a developing device 35 which develops the electrostatic latent image formed on the photoconductor 32 with a toner of each color component, and a cleaning device 36 which removes the toner remaining on the photoconductor 32 after primary transfer to the intermediate transfer body 40 are sequentially arranged.

In this example, as the charging device 33, a charging roller which charges the photoconductor 32 in a contact manner, or a corotron or scorotron which charges the photoconductor 32 in a non-contact manner is used.

Further, the latent image writing device 34 may be used to separately write an electrostatic latent image for each image forming unit 31 using, for example, an LED array, but is not limited to this, and a common laser scanning device may write an electrostatic latent image of each color component for each image forming unit 31 using a corresponding laser beam, or respective laser scanning devices may be provided separately.

Further, the developing device 35 may be configured such that a two-component developer containing, for example, a toner and a carrier is used, a developing roller is arranged in a developing container, and for example, multiple agitation transport members are also arranged in the developing container to charge the developer while agitating and mixing the developer, but is not limited to this, and may be appropriately selected.

Furthermore, as the cleaning device 36, a cleaning member such as a cleaning blade, a cleaning brush, or a cleaning roller which scrapes off the toner remaining on the photoconductor 32 is appropriately selected and used.

Further, reference numeral 37 (specifically, 37*a* to 37*d*) is a toner cartridge that supplies a toner of each color component to each developing device 35 of each image forming unit 31 (31*a* to 31*d*).

Intermediate Transfer Body

Further, in this example, the intermediate transfer body 40 includes, for example, a belt-shaped member wound around multiple tension rollers 41 to 44, and is driven to rotatably circulate in a predetermined direction using, for example, the tension roller 41 as a driving roller, and the tension roller 43 is adapted to function as a tension applying roller that applies a desired tension to the intermediate transfer body 40.

Further, a primary transfer device 46 (for example, a primary transfer roller being used) is provided on the back surface of the intermediate transfer body 40 facing the photoconductor 32 of each image forming unit 31. The primary transfer device 46 is adapted to primarily transfer the image on the photoconductor 32 to the intermediate transfer body 40 by applying a primary transfer electric field onto the photoconductor 32.

Further, reference numeral 47 is, for example, an cleaning device for the intermediate transfer body that is provided on a portion of the intermediate transfer body 40 facing the tension roller 41 to remove a residue (for example, toner or paper dust) on the intermediate transfer body 40.

Collective Transfer Device

In the present exemplary embodiment, the collective transfer device 60 has a basic configuration in which a transfer roller 61 faces the tension roller 42 on the intermediate transfer body 40, and for example, the transfer roller 61 is grounded, while a transfer voltage is applied from a transfer power supply (not illustrated) to the tension roller 42 to create a transfer electric field in a transfer region between the intermediate transfer body 40 and the transfer roller 61, so that the image on the intermediate transfer body 40 is secondarily transferred to the sheet passing through the transfer region.

Fixing Device

Further, in the present exemplary embodiment, the fixing device 70 includes a rotatable heating fixing member (a heating fixing roller being used in this example) 71, the surface temperature of which is heated to a predetermined temperature by a heater serving as a heating source, and a pressure fixing member (a pressure fixing roller being used in this example) 72 which performs rotational movement in a contact manner with a predetermined contact pressure along the axial direction of the heating fixing member 71. The fixing device 70 is adapted to fix an unfixed image held on the sheet by passing the sheet through the contact area of both the fixing members 71 and 72.

Sheet Transport System

In the present exemplary embodiment, with the sheet transport system, the sheet is sent from a feeder portion 51 of the sheet supply container 50 to the transport path 55, the position of the sheet is aligned by a positioning roller 56 provided upstream, in the sheet transport direction, of the batch transfer region of the collective transfer device 60 in the transport path 55 and thereafter, a transfer processing is performed on the sheet by the collective transfer device 60. Furthermore, the sheet that has undergone the fixing processing by the fixing device 70 is discharged with a discharge roller 57 toward the sheet discharge tray 58 formed on the top of the apparatus housing 21. Moreover, needless to say, the transport path 55 may be provided with an appropriate number of transport members (for example, transport rollers) as needed. Further, in a case where a duplex image forming mode is carried out, a duplex transport unit (not illustrated) may be added.

Waste Developer Transport Unit

Figure 3:
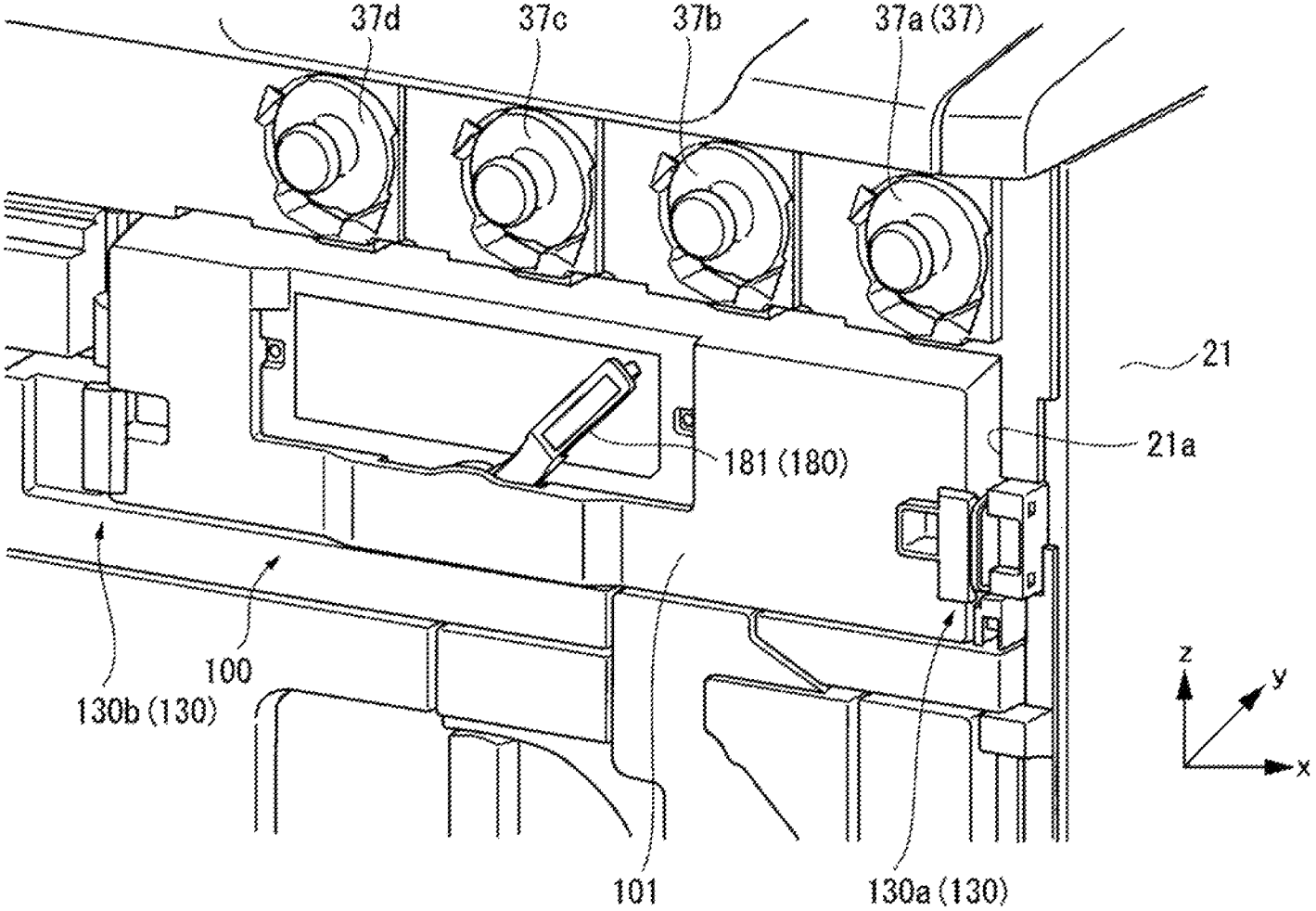
FIG. 3 is a view illustrating the periphery of a waste developer transport unit serving as the detachable container when a front opening and closing door of an apparatus housing of the powder processing apparatus according to the first exemplary embodiment is opened.

In the present exemplary embodiment, as illustrated in FIGS. 2 and 3, an opening and closing door (not illustrated) is provided on the front side of the apparatus housing 21, and a waste developer transport unit 100 serving as the detachable container is provided inside the opening and closing door of the apparatus housing 21.

In this example, the waste developer transport unit 100 targets the following two-system waste developer.

(1) The cleaning device 36 of each image forming unit 31 (31*a* to 31*d*) removes a waste toner as the waste developer remaining on the photoconductor 32. The removed waste toner is primarily stored in a cleaning container, but is discharged from one end of the cleaning container and transported to the waste developer transport unit 100 by way of transport ducts 111 to 114 (see FIG. 5) at a transport member provided inside the cleaning container, and is collected in a waste developer collection box (not illustrated) by way of the waste developer transport unit 100.

(2) Since the developing device 35 of each image forming unit 31 (31*a* to 31*d*) consumes the toner as a two-component developer but the carrier remains unconsumed, there is a risk of the carrier impairing charging characteristics of the developer as it ages. Therefore, in this example, the waste carrier as the old developer (waste developer) is periodically discarded from the developing container to the outside, and then is transported to the waste developer transport unit 100 by way of the transport ducts 116 to 119 (see FIG. 5) and is collected in the waste developer collection box (not illustrated) by way of the waste developer transport unit 100.

Configuration Example of Waste Developer Transport Unit

Figure 4:
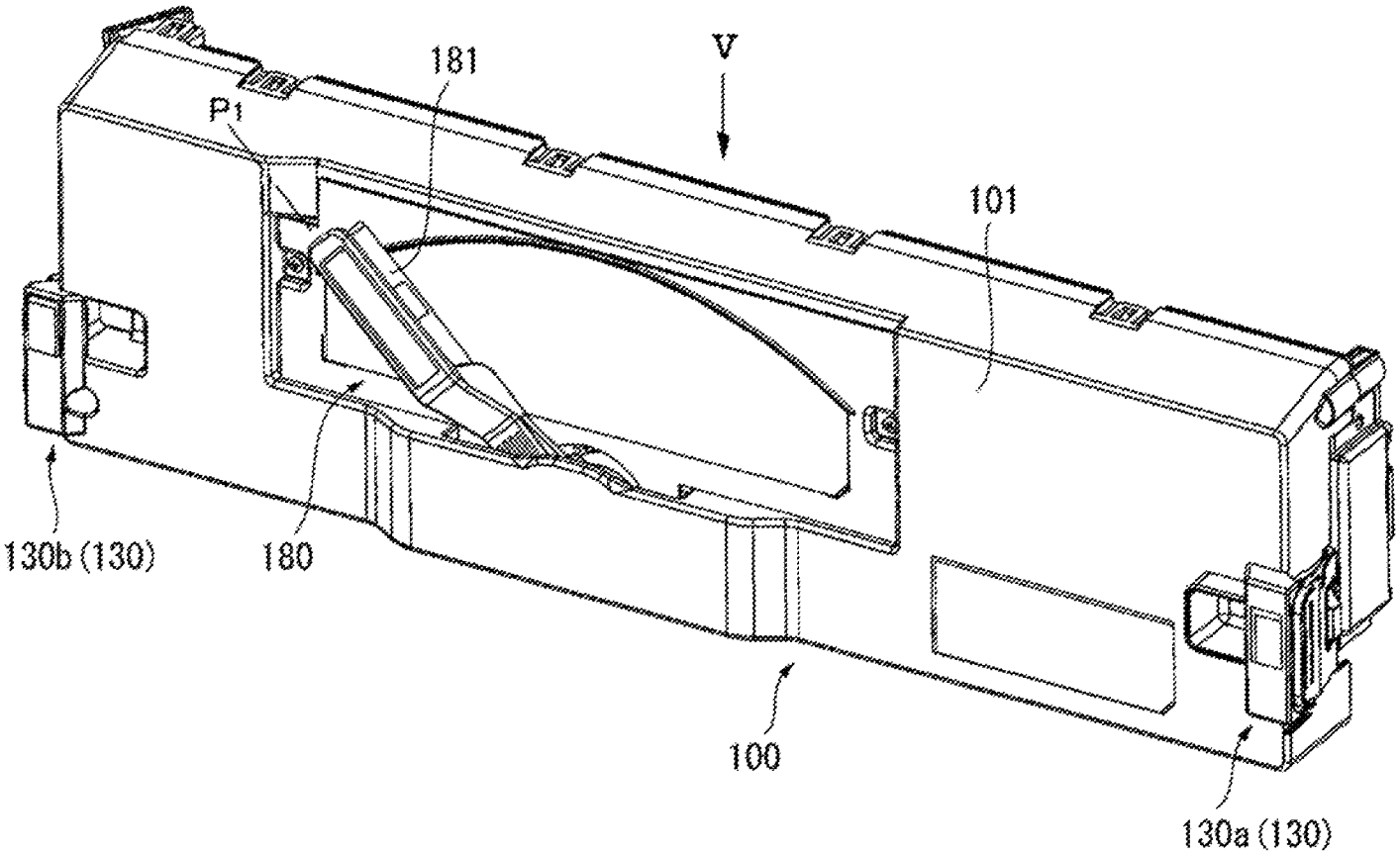
FIG. 4 is a perspective view illustrating the outer appearance when a waste developer transport unit according to the first exemplary embodiment is not attached.
Figure 5:
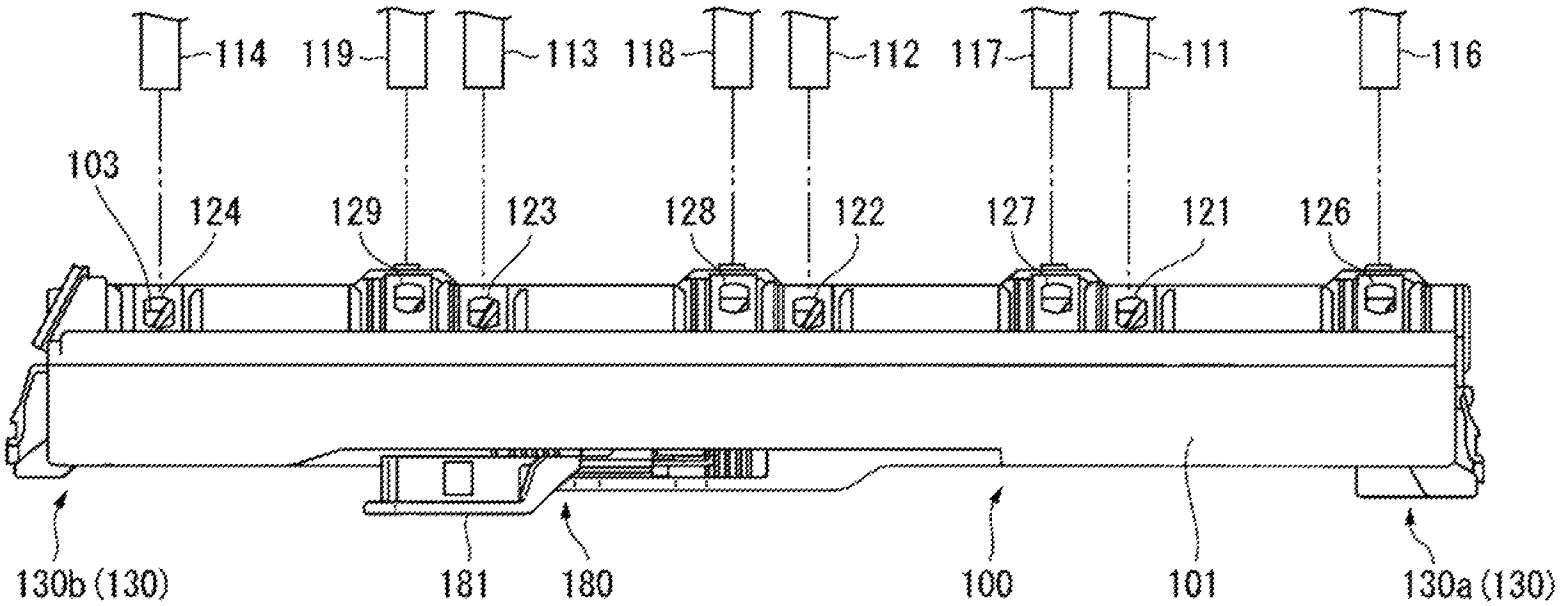
FIG. 5 is a view seen from a direction indicated by an arrow V in FIG. 4.

In this example, as illustrated in FIGS. 3 to 5, the waste developer transport unit 100 has a unit case 101 serving as the container body that is detachably attached to a receiving portion 21*a* of the apparatus housing 21. The unit case 101 has a substantially rectangular parallelepiped shape that is long in the width direction (corresponding to a direction indicated by an arrow x in FIG. 3) intersecting with the attachment and detachment direction (corresponding to a direction indicated by an arrow y in FIG. 3). A passage forming member (not illustrated) in which the waste developer (waste toner and waste carrier) is accommodated is arranged along the width direction in the unit case 101, and a transport member (for example, a spiral blade member around the rotational axis) 103 is arranged in the passage forming member.

Then, gripping knobs 130 (specifically, 130*a* and 130*b*) serving as grippers are provided respectively on both sides in the width direction of the surface of the unit case 101 on the attachment and detachment operation side (corresponding to the front side of the apparatus housing 21). Here, the positions of the respective gripping knobs 130 (130*a* and 130*b*) may be appropriately selected depending on the structure of the apparatus housing 21 on the receiving portion 21*a* side. In case of this example, the gripping knobs 130*a* and 130*b* are not arranged asymmetrically about the center in the width direction of the unit case 101, but the first gripping knob 130*a* (130) positioned in the right direction as viewed from the attachment and detachment operation side of the unit case 101 is arranged offset upward with respect to the height direction z as compared with the second gripping knob 130*b* (130) located in the opposite left direction.

Figure 6:
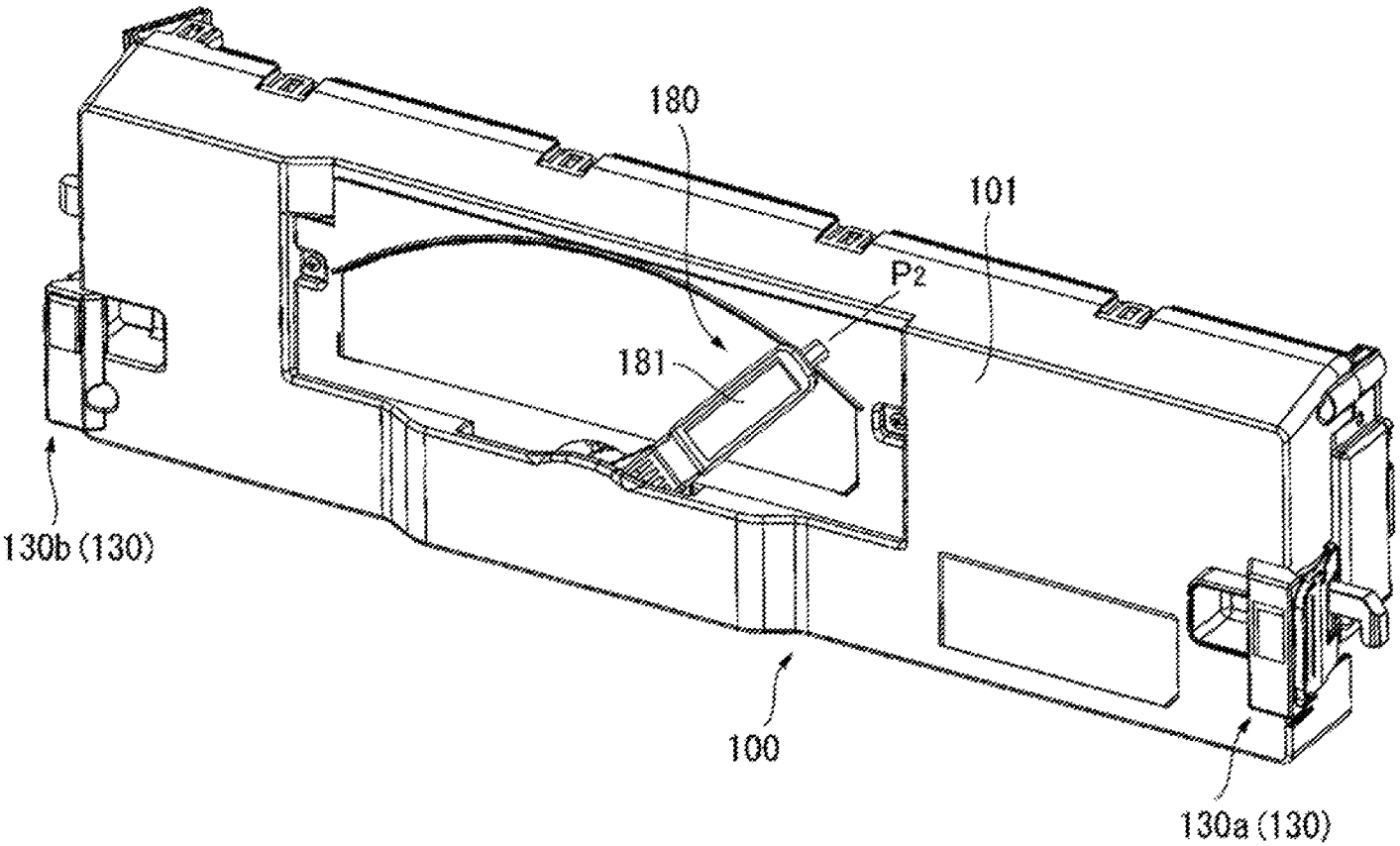
FIG. 6 is a perspective view illustrating the outer appearance in a state where an operation lever is rotated to a fixing position after the waste developer transport unit according to the first exemplary embodiment is attached.

Furthermore, a locking mechanism 180 is provided near approximately the widthwise center of the attachment and detachment operation side surface of the unit case 101, and has an operation lever 181 serving as the operation unit that is capable of swinging between a predetermined restraint position and a predetermined restraint release position. As such, for example, the locking mechanism 180 locks the operation lever 181 to disable the rotational operation of the operation lever 81 by holding the operation lever 181 at the restraint position when the waste developer transport unit 100 is not attached, as illustrated in FIG. 4, but unlocks the operation lever 181 to enable the rotational operation of the operation lever 181 by moving the operation lever 181 to the restraint release position when the waste developer transport unit 100 is attached, as illustrated in FIG. 6. By rotating the unlocked operation lever 181 from a rotation initial position P1 illustrated in FIG. 4 to the rotation terminal position P2 illustrated in FIG. 6, the intermediate transfer body 40 is set to a predetermined setting position with respect to the photoconductor 32 and the waste developer transport unit 100 is fixed inseparably with respect to the receiving portion 21*a* of the apparatus housing 21 in conjunction with the rotation of the operation lever 181.

Details of such a behavior will be described later.

Further, the back surface of the unit case 101 located opposite to the attachment and detachment operation side surface is provided with connection ports 121 to 124 to which the transport ducts 111 to 114 from the cleaning devices 36 of the respective image forming units 31 are connectable. The back surface of the unit case 101 is further provided with connection ports 126 to 129 to which the transport ducts 116 to 119 from the developing device 35 of each image forming unit 31 are connectable. Then, each of the connection ports 121 to 124 and 126 to 129 is provided with an opening and closing shutter (not illustrated) serving as the opening and closing unit that opens and closes each connection port.

Locking Mechanism (Locked State)

Figure 7:
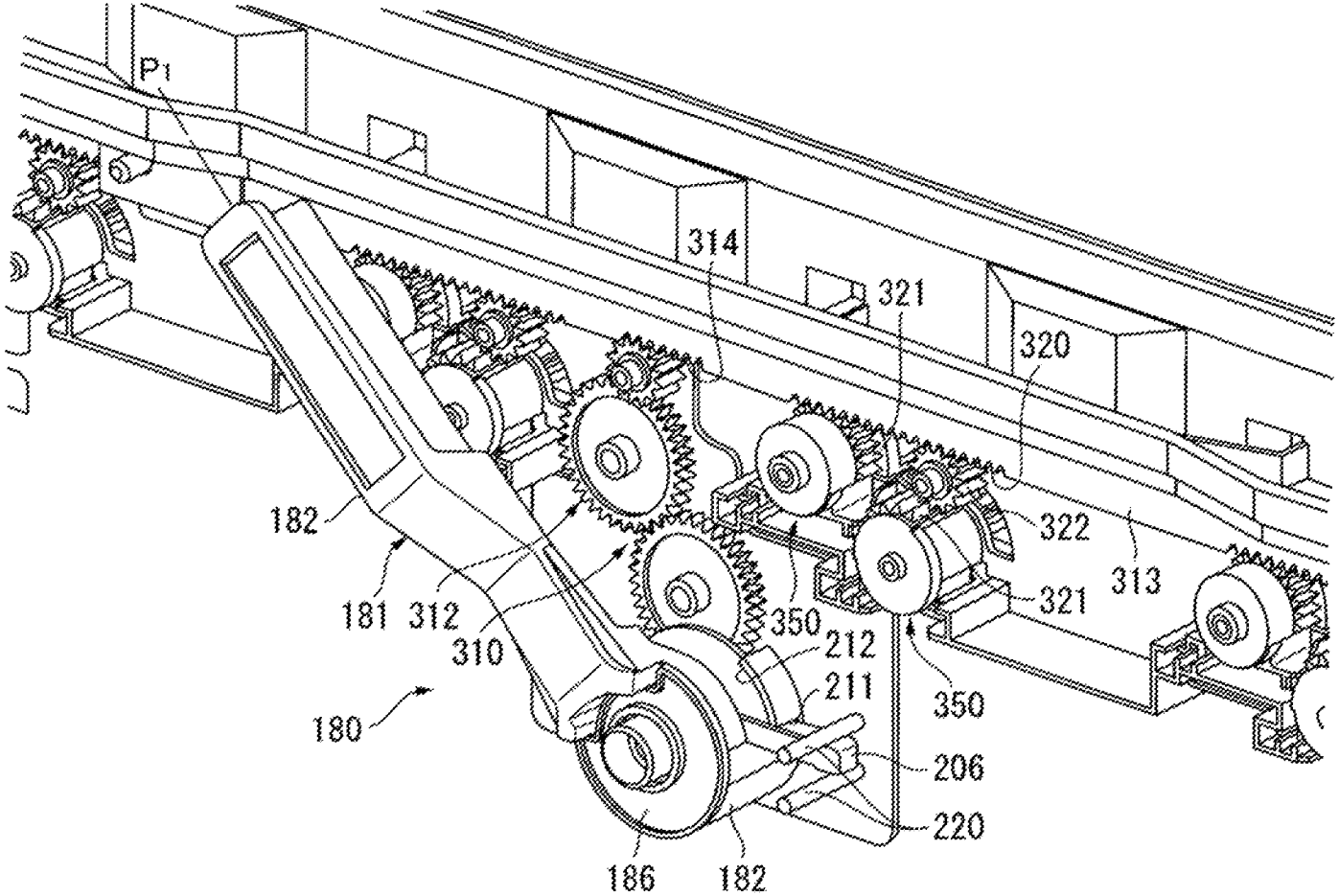
FIG. 7 is a view illustrating the locked state of a locking mechanism of the waste developer transport unit according to the first exemplary embodiment.
Figure 8:
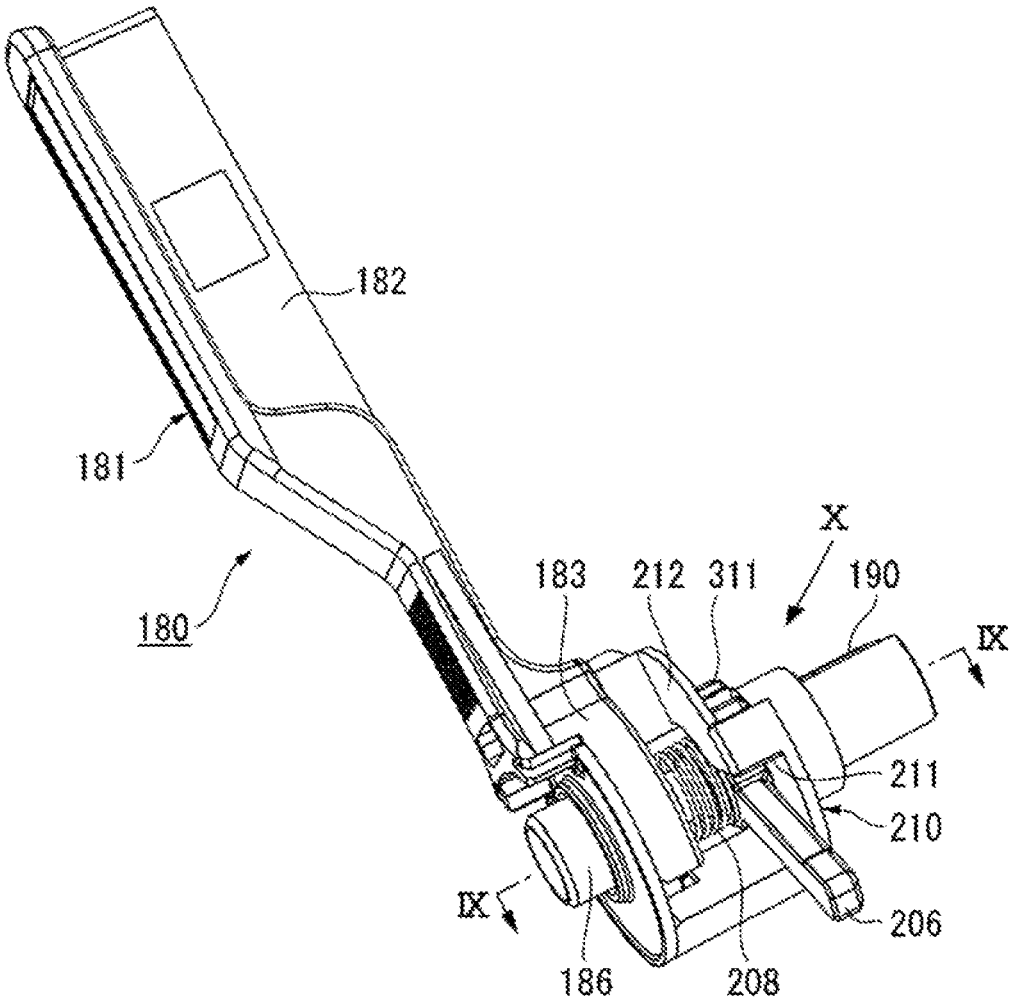
FIG. 8 is a view illustrating details of the locking mechanism illustrated in FIG. 7.

FIG. 7 illustrates the locking mechanism 180 in the locked state.

Figure 9:
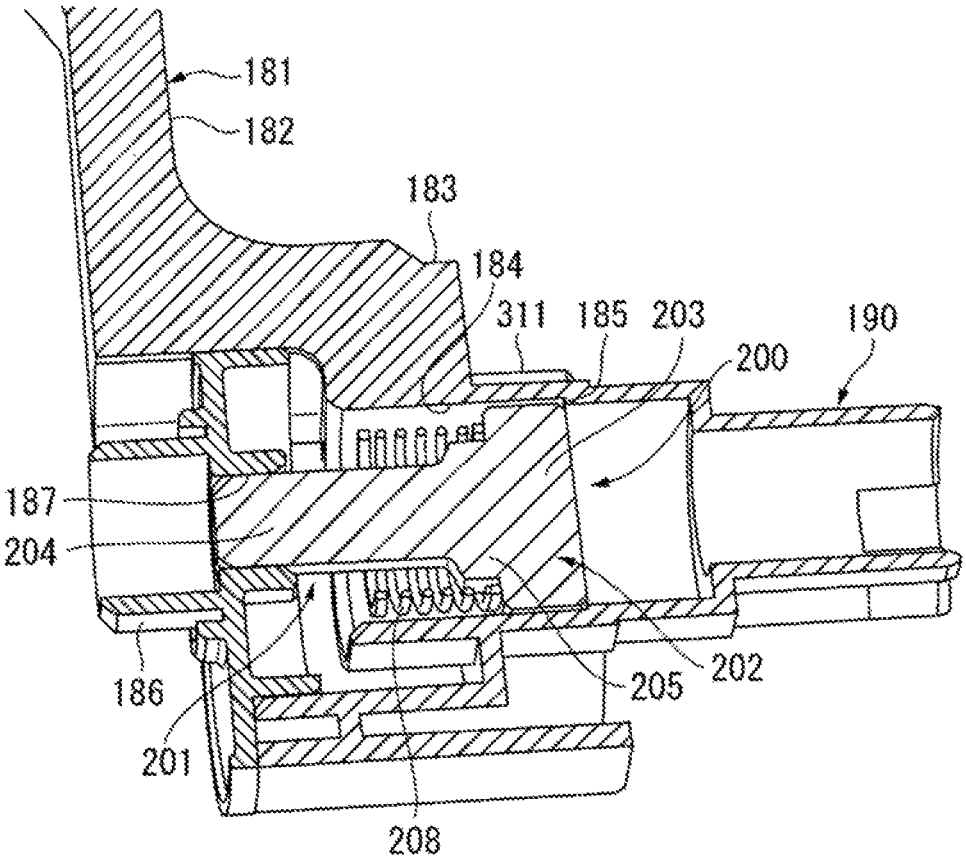
FIG. 9 is a cross-sectional view taken along line IX-IX in FIG. 8.
Figure 10:
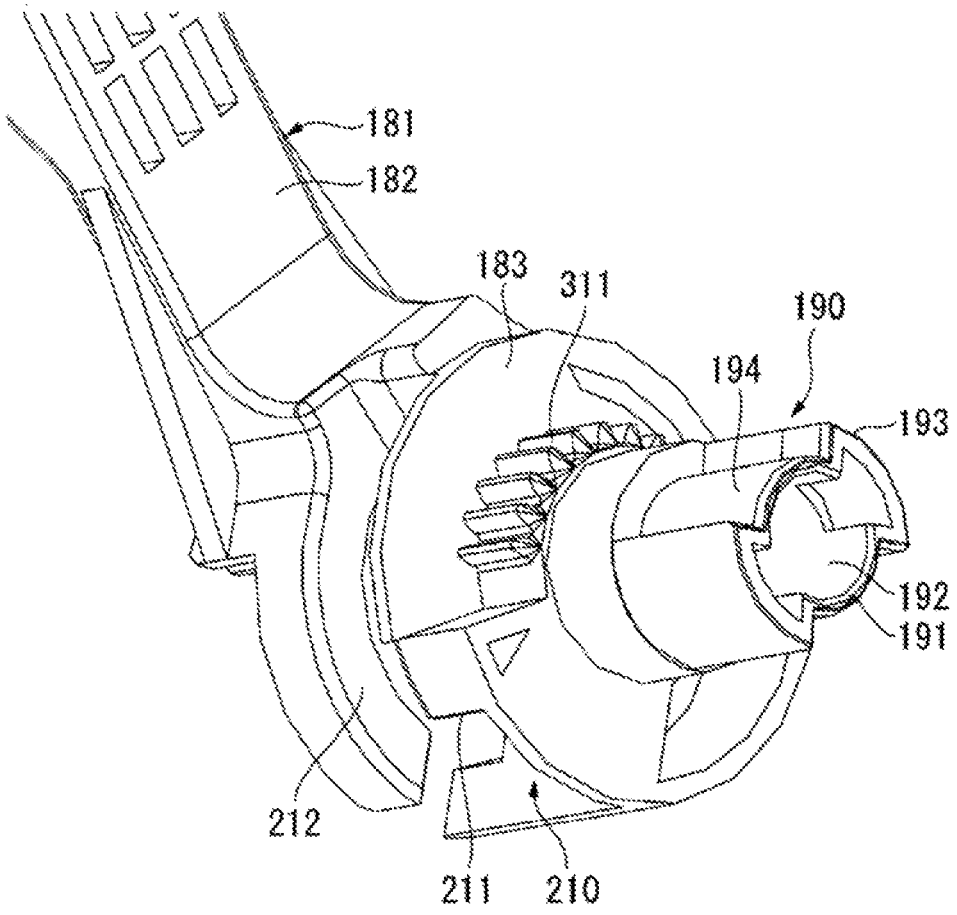
FIG. 10 is a view seen from a direction indicated by an arrow X in FIG. 8.
Figure 11:
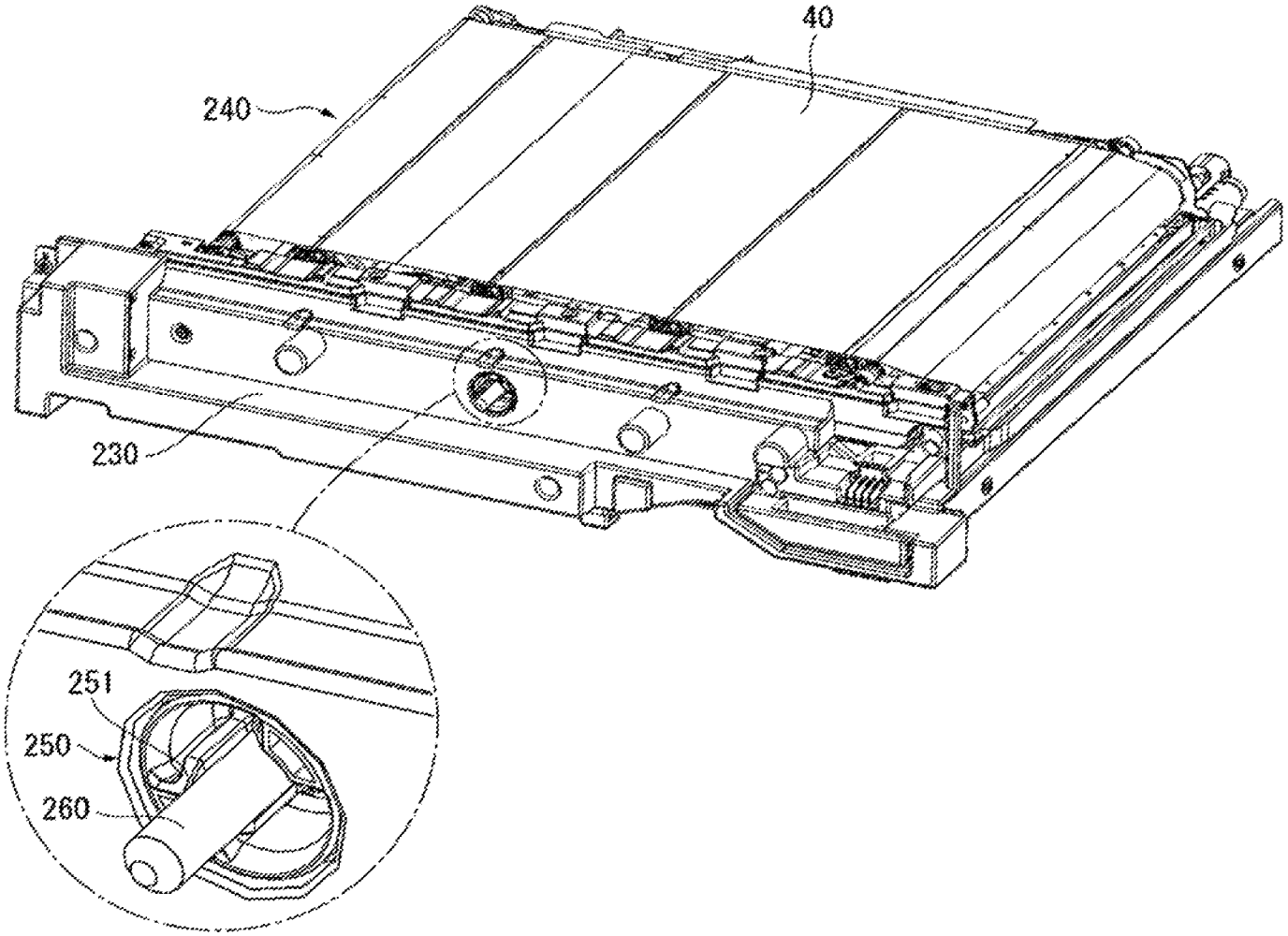
FIG. 11 is a view illustrating an exemplary interior configuration of the apparatus housing on a back surface side of the waste developer transport unit.

In FIG. 7, the locking mechanism 180 includes the operation lever 181 in which a lever body 182 and a shaft portion 183 are integrally formed, a joining coupling 190 which is provided coaxially with the shaft portion 183 on the back surface side of the shaft portion 183 of the operation lever 181 (corresponding to the back surface side of the waste developer transport unit 100) and is capable of being joined with a joined coupling 250 serving as the joined unit 13 illustrated in FIG. 11, and a restraint mechanism 200 which is provided coaxially with the shaft portion 183 of the operation lever 181 and serves as the restraint unit that restrain the operation lever 181 at the rotation initial position P1 (see FIG. 4) and releases the operation lever 180 from the restrained state to rotate it to the rotation terminal position P2 (see FIG. 6), as illustrated in FIGS. 7 to 10.

Operation Lever

In this example, the shaft portion 183 of the operation lever 181 has a cylindrical hollow bore 184, and a stepped portion 185 having slightly different inner diameters is formed in the middle of the bore 184. Then, a shaft cover 186 is attached to the front surface side of the shaft portion 183 (corresponding to the attachment and detachment operation side of the waste developer transport unit 100), and a pin insertion through-hole 187 having a diameter smaller than that of the bore 184 is formed in the center of the shaft cover 186.

Joining Coupling

In this example, as illustrated in FIGS. 9 and 10, the joining coupling 190 has a coupling body 191 integrally formed on the back surface side of the shaft portion 183 of the operation lever 181. A bore 192 through which a pin having a circular cross section may be inserted is formed in the coupling body 191 and also, convex portions 193 having an outwardly protruding outer peripheral wall are formed at portions of the coupling body 191 which pass through the center of the bore 192 and are opposite to each other by about 180 degrees. Also, concave portions 194 are secured between these convex portions 193.

Restraint Mechanism

In this example, as illustrated in FIGS. 7 to 10, the restraint mechanism 200 includes a movable lock element 201 that is movable from the restraint position where the movable lock element 201 restrains the operation lever 181 to the restraint release position where the movable lock element 201 releases the operation lever 181 from the restrained state, and a fixed lock element 210 that restrains the operation lever 181 in conjunction with the movable lock element 201 at the restraint position.

Movable Lock Element

Here, the movable lock element 201 is accommodated in the bore 184 of the shaft portion 183 of the operation lever 181, and has a slide pin 202 serving as the moving element that is movable along the axial direction of the bore 184. The slide pin 202 has a columnar guide base 203 which slides along the bore 184 and is blocked by the stepped portion 185 formed in the middle of the bore 184, a columnar pin body 204 which extends from the guide base 203 toward the shaft cover 186 side and has a smaller diameter than that of the guide base 203, and a stepped portion 205 provided at the boundary between the guide base 203 and the pin body 204. A protruding end of the pin body 204 is slidably held in the pin insertion through-hole 187 of the shaft cover 186.

Furthermore, the stepped portion 205 of the slide pin 202 is provided with a protruding arm 206 serving as the protruding element that protrudes radially, and further, a coil spring 208 serving as an urging unit is wound around the pin body 204 of the slide pin 202 to constantly urge the slide pin 202 against the stepped portion 185 side of the bore 184. Moreover, the protruding arm 206 is provided on the stepped portion 205, but is not limited to this, and the protruding arm 206 may be provided on the guide base 203 or the pin body 204.

In this example, when the slide pin 202 is pressed from the back surface side of the guide base 203, it functions as a moving mechanism that moves to the front surface side along the bore 184 of the shaft portion 183 against the urging force of the coil spring 208.

Further, in this example, as illustrated in FIG. 7, the protruding arm 206 of the movable lock element 201 protrudes between a pair of rotation stop bars 220 serving as the rotation stop provided on the unit case 101, and is stopped from rotating by the rotation stop bars 220 sandwiching the protruding arm 206 from the top and bottom thereof.

Moreover, the protruding arm 206 is adapted to move forward and backward in the axial direction of the operation lever 181 to follow the forward and backward movements of the slide pin 202, but remains stopped from rotating by the pair of rotation stop bars 220.

Fixed Lock Element

Further, the fixed lock element 210 forms an enclosure 211 having a substantially rectangular notch shape on a part of the back side of a peripheral wall of the shaft portion 183 of the operation lever 181. When the protruding arm 206 of the movable lock element 201 is caught by the enclosure 211 to rotate, for example, the operation lever 181 about the shaft portion 183, the enclosure 211 collides with the protruding arm 206, and the rotation of the operation lever 181 is locked.

Further, a slit 212 is formed in the peripheral wall of the shaft portion 183 of the operation lever 181 to extend in the circumferential direction at a position adjacent to the enclosure 211. The slit 212 functions as a passage for rotating the operation lever 181 from the rotation initial position P1 (see FIG. 4) to the rotation terminal position P2 (see FIG. 6) when the protruding arm 206 reaches a position where it is disengaged from the enclosure 211 of the fixed lock element 210.

Configuration Example of Apparatus Housing on Back Surface Side of Waste Developer Transport Unit As illustrated in FIG. 3, when the waste developer transport unit 100 is separated from the receiving portion 21*a* of the apparatus housing 21, for example, a housing frame 230 constituting the apparatus housing 21 is exposed as illustrated in FIG. 11, and the intermediate transfer unit 240 (including the intermediate transfer body 40, the tension rollers 41 to 44, the primary transfer device 46, and a unit frame supporting these) is assembled to the housing frame 230.

Joined Coupling

Figure 12:
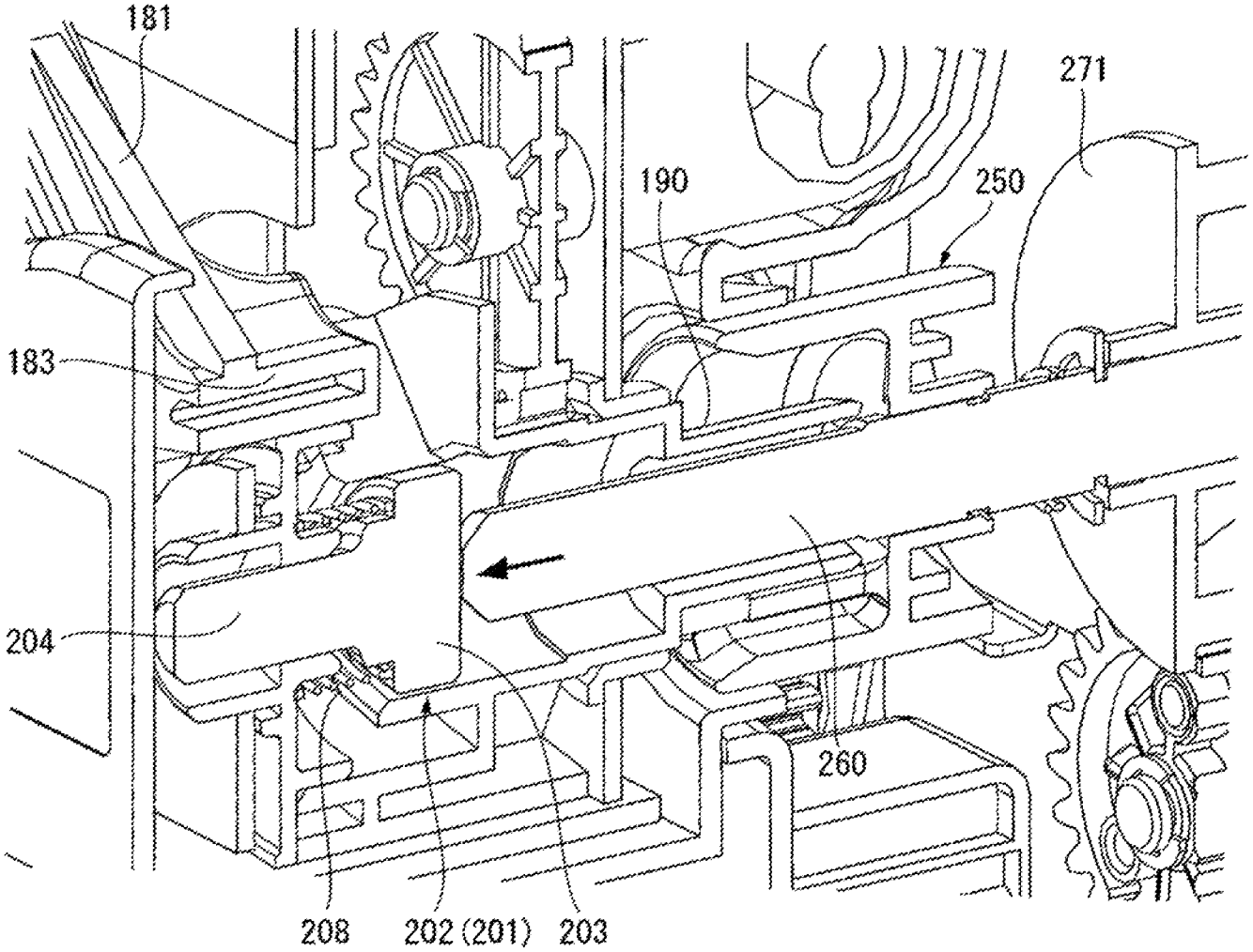
FIG. 12 is a view illustrating the behavior of the locking mechanism leading to unlocking when the waste developer transport unit is attached.

In this example, a part of the housing frame 230 is provided with a joined coupling 250 as the joined unit, as illustrated in FIGS. 11 and 12.

In this example, the joined coupling 250 has a joining portion 251 which fits with the joining coupling 190 at a predetermined angular position. Specifically, the joining coupling 190 and the joined coupling 250 have a joining positional relationship under a condition in which the operation lever 181 is locked at the rotation initial position P1.

Restraint Release Shaft

Further, in this example, as illustrated in FIG. 11, a restraint release shaft 260 serving as the restraint release element is provided coaxially with the joined coupling 250. The restraint release shaft 260 is arranged along the axial center of the joined coupling 250, and further protrudes toward the front surface than the joined coupling 250. Therefore, in this example, as illustrated in FIG. 12, the restraint release shaft 260 collides with the back surface side of the slide pin 202 of the movable lock element 201 in the restraint mechanism 200 of the locking mechanism 180 to push the slide pin 202 against the urging force of the coil spring 208 when the waste developer transport unit 100 is attached.

In this state, the locking mechanism 180 reaches the unlocked state.

Locking Mechanism (Unlocked State)

Figure 13:
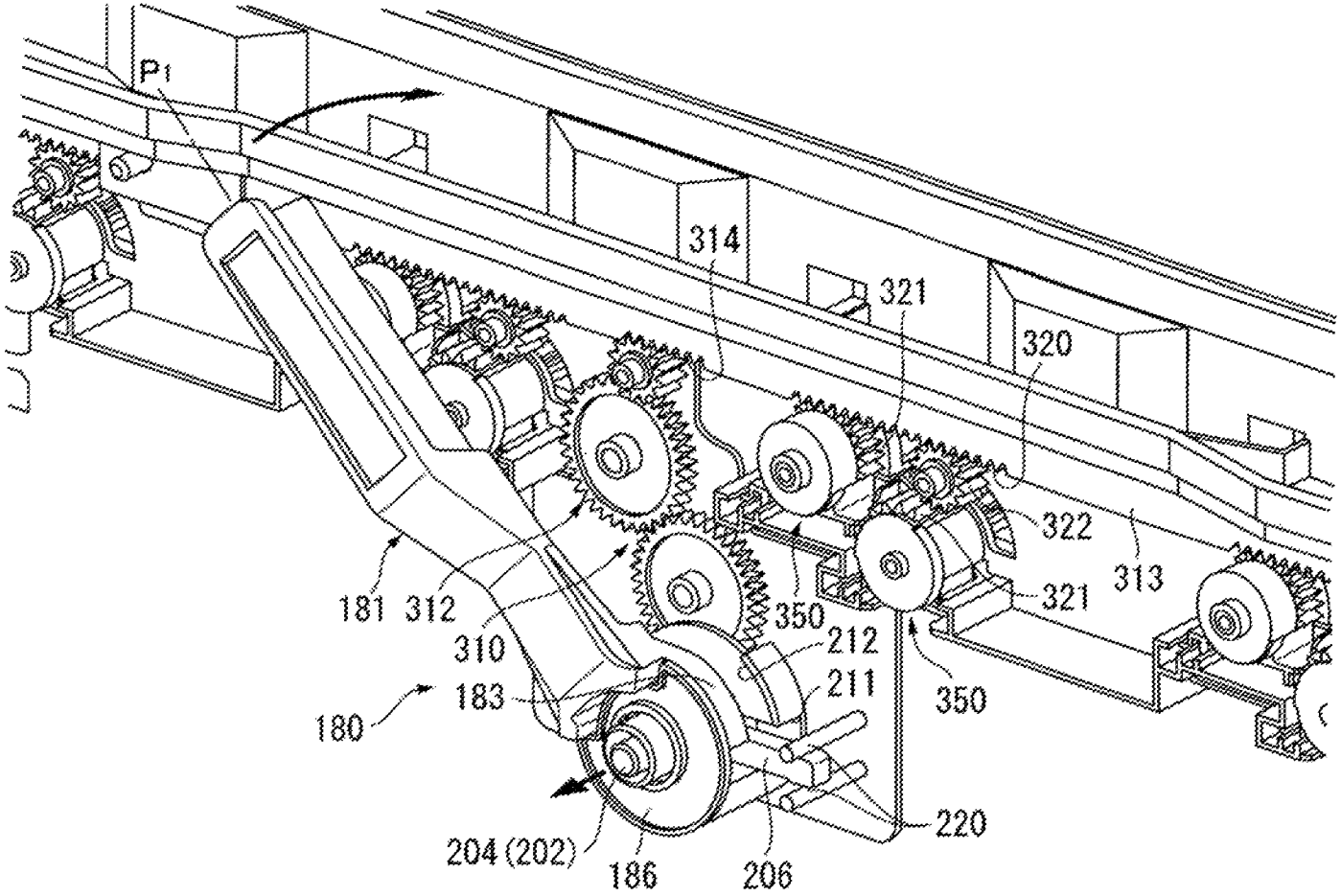
FIG. 13 is a view illustrating a state around the operation lever when the locking mechanism is unlocked.
Figure 14:
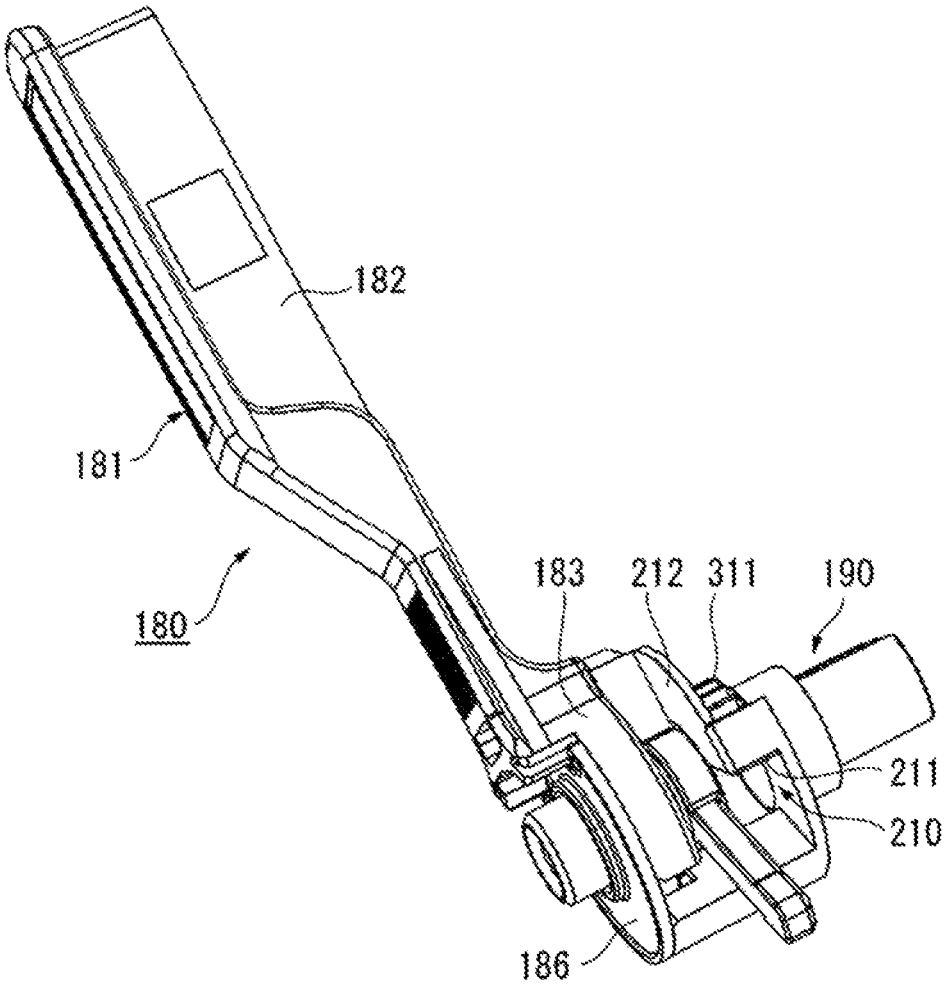
FIG. 14 is a view illustrating details of the locking mechanism in the unlocked state.

FIGS. 13 and 14 illustrate the locking mechanism 180 in the unlocked state.

In FIGS. 13 and 14, when the waste developer transport unit 100 is attached in the receiving portion 21*a* of the apparatus housing 21, as illustrated in FIG. 12, the joining coupling 190 and the joined coupling 250 are joined with each other in the shaft portion 183 of the operation lever 181 of the locking mechanism 180 and also, the restraint release shaft 260 collides with the slide pin 202 of the movable lock element 201.

At this time, as the slide pin 202 is pushed out by the restraint release shaft 260, the protruding arm 206 integrally provided on the slide pin 202 moves to the front surface side. Thus, the protruding arm 206 is disengaged from the enclosure 211 and moves to a region inside the slit 212. In this state, since the protruding arm 206 is stopped from rotating by the pair of rotation stop bars 220, when the operation lever 181 is rotated clockwise from the rotation initial position P1 about the shaft portion 183 as the rotation center, the protruding arm 206 moves along the longitudinal direction of the slit 212.

Figure 15:
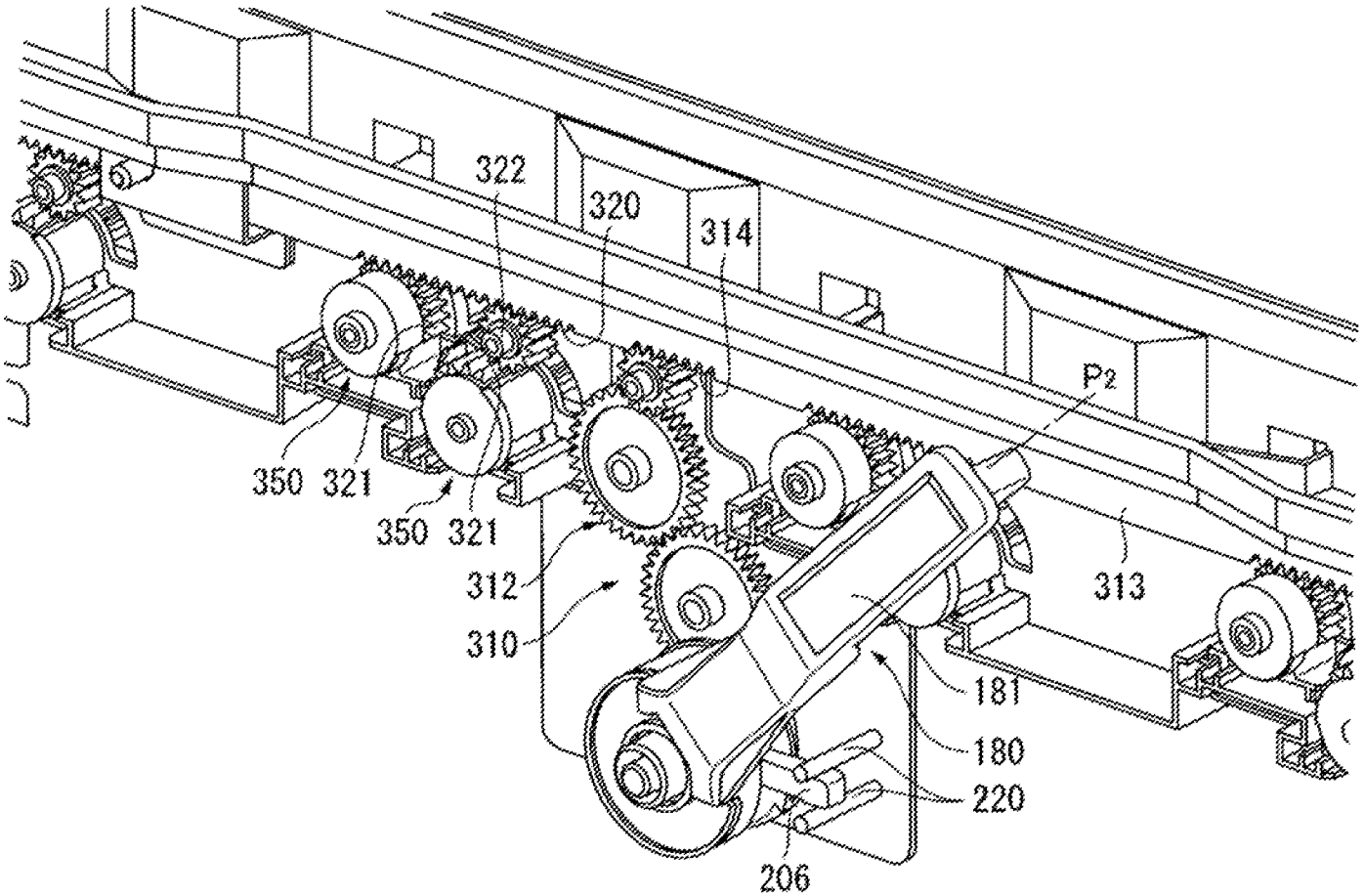
FIG. 15 is a view illustrating a state where the operation lever of the locking mechanism in the unlocked state is rotated to a fixing position, thereby fixing the waste developer transport unit with respect to the apparatus housing.

As a result, as illustrated in FIG. 15, the operation lever 181 rotates to and stops at the rotation terminal position P2.

Attachment and Detachment Work of Waste Developer Transport Unit

In this example, in the waste developer transport unit 100 before being attached, the locking mechanism 180 is in the locked state. Therefore, it is impossible to rotate (perform a rotational operation for) the operation lever 181. Therefore, there is no risk of the operation lever 181 being erroneously operated while the waste developer transport unit 100 is stored.

Next, in a case where the waste developer transport unit 100 is attached to the receiving portion 21*a* of the apparatus housing 21, the locking mechanism 180 is in the locked state, but the restraint release shaft 260 is inserted into the shaft portion 183 of the operation lever 181 of the locking mechanism 180 and the slide pin 202 is pushed out by the restraint release shaft 260. After the locking mechanism 180 reaches the unlocked state, the operation lever 181 is rotated to the rotation terminal position P2, so that, as will be described later, the waste developer transport unit 100 is fixed in the retaining state, and the intermediate transfer unit 240 is set to a setting state.

Further, in a case where the waste developer transport unit 100 is separated from the receiving portion 21*a* of the apparatus housing 21, after the operation lever 181 is returned from the rotation terminal position P2 to the rotation initial position P1, the waste developer transport unit 100 may be pulled out to the front side by using the gripping knobs 130 (130*a* and 130*b*).

Technical Matters Associated with Locking Mechanism

In this example, the following technical matters are achieved in conjunction with the rotational operation of the operation lever 181 of the locking mechanism 180.

(1) Rotational driving of the joined coupling
(2) Setting operation of the intermediate transfer unit
(3) Retaining operation of the waste developer transport unit
(4) Opening operation of the opening and closing shutter at each connection port of the waste developer transport unit Rotational Driving of Joined Coupling In this example, in a case where the locking mechanism 180 reaches the unlocked state, the slide pin 202 is pushed out by the restraint release shaft 260, but in order to realize the pushing operation of the slide pin 202 by the restraint release shaft 260, it is necessary as a prerequisite to ensure that the joining coupling 190 and the joined coupling 250 are joined with each other. If both the couplings 190 and 250 are incompletely joined with each other, the restraint release shaft 260 and the slide pin 202 are not arranged coaxially, which makes it impossible for the slide pin 202 to be pushed out by the restraint release shaft 260.

In this way, in a case where the joining coupling 190 and the joined coupling 250 are securely joined with each other, both the couplings 190 and 250 rotate by the rotation angle of the operation lever 181 from the rotation initial position P1 to the rotation terminal position P2.

Therefore, for example, the following setting of the intermediate transfer unit 240 may be realized by using a predetermined rotation of the joined coupling 250.

Setting Operation of Intermediate Transfer Unit

Figure 16:
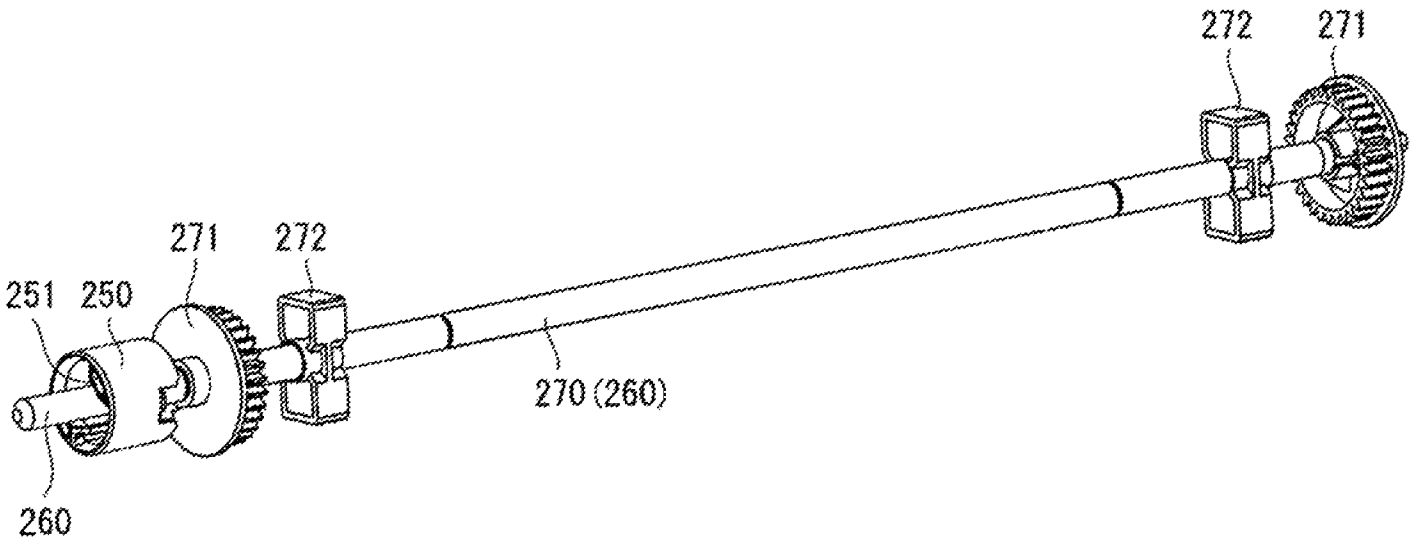
FIG. 16 is a view illustrating a joined coupling to be joined to a coupling of the locking mechanism of the waste developer transport unit and a retract drive mechanism provided coaxially with the joined coupling.

In this example, as illustrated in FIG. 16, the restraint release shaft 260 is configured to also serve as a drive transmission shaft 270 (corresponding to a retract drive mechanism) for driving a retract mechanism of the intermediate transfer unit 240.

Figure 17:
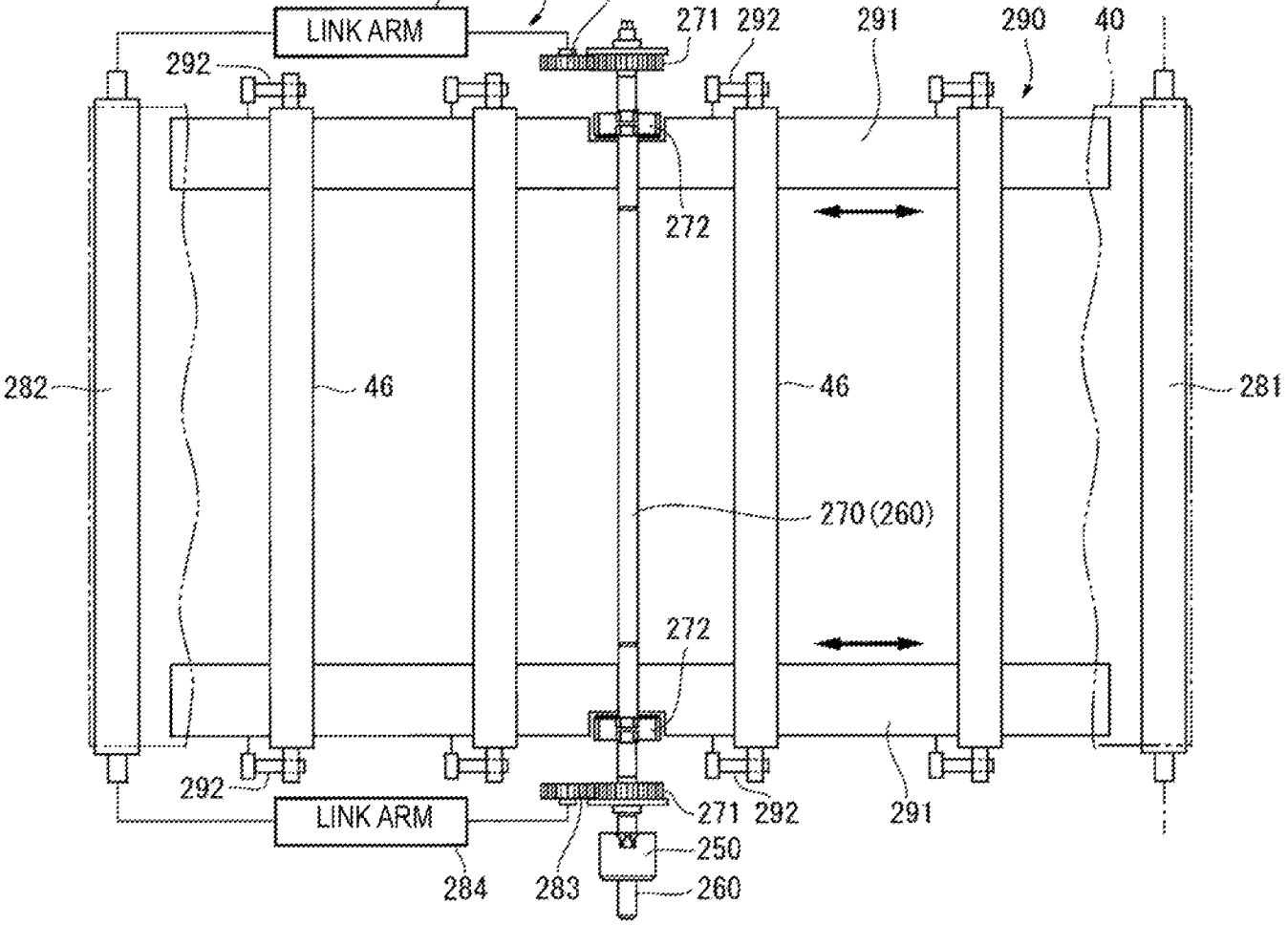
FIG. 17 is a view illustrating an exemplary operation of a retract mechanism of an intermediate transfer unit in conjunction with a fixing operation of the operation lever illustrated in FIG. 15.
Figure 18A:
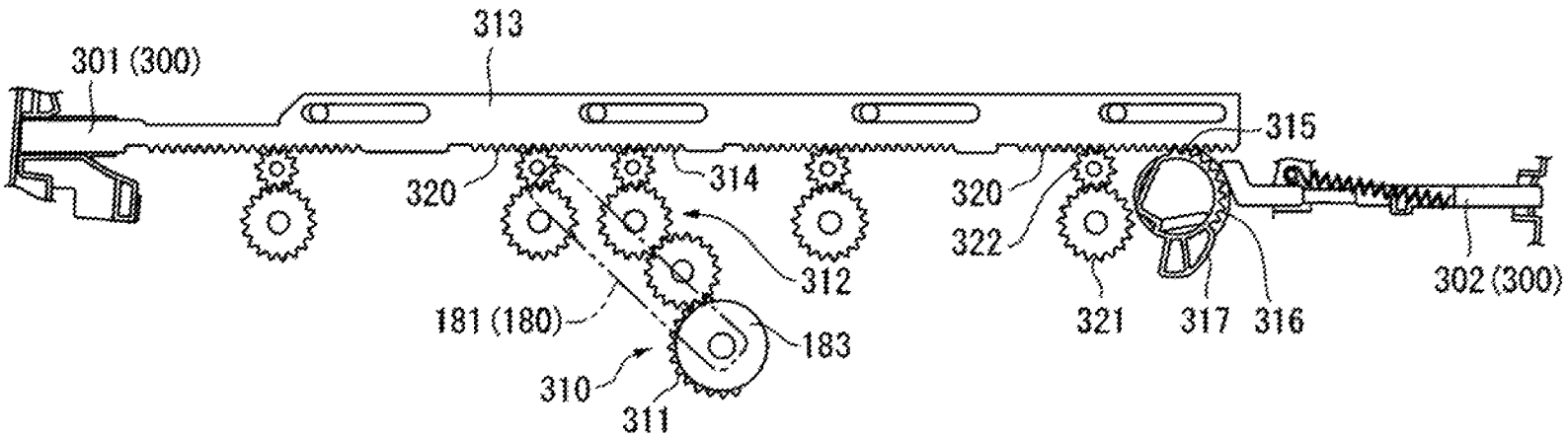
FIG. 18A is a view illustrating a state of a retaining mechanism of the waste developer transport unit when the operation lever is located at an unlocking initial position in the locking mechanism of the waste developer transport unit.
Figure 18B:
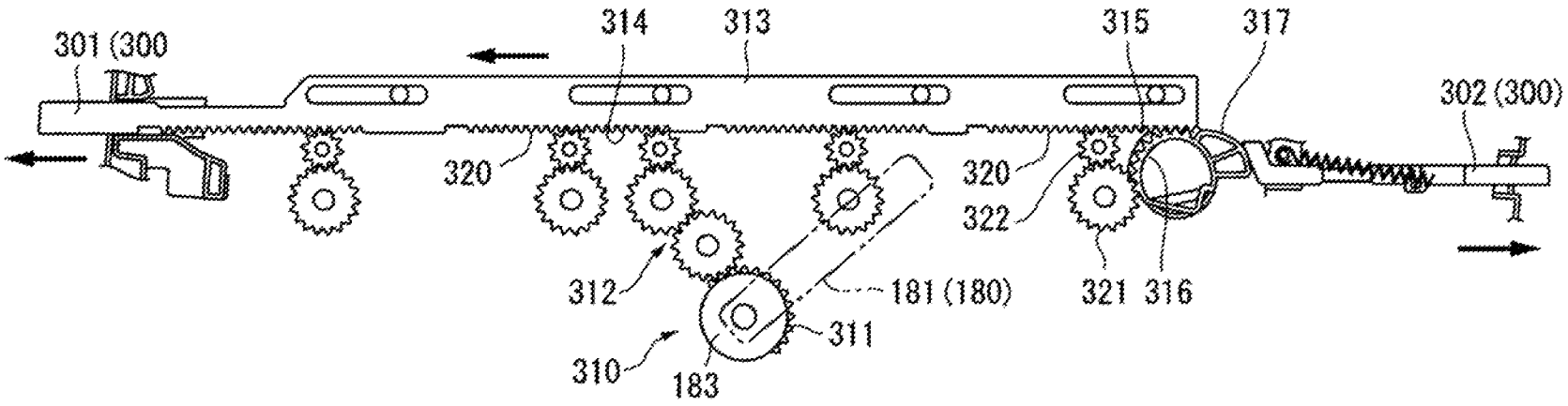
FIG. 18B is a view illustrating an exemplary operation of the retaining mechanism of the waste developer transport unit when the operation lever is rotated to a fixing position.

As illustrated in FIGS. 16 and 17, the drive transmission shaft 270 passes through the width direction of the intermediate transfer body 40 intersecting with the movement direction thereof, a pair of gear handles 271 are anchored near both sides in the longitudinal direction of the drive transmission shaft 270, and a pair of cam handles (having a small-diameter cam surface and a large-diameter cam surface with respect to the center of the drive transmission shaft 270) 272 are anchored inside the pair of gear handles 271.

Here, the retract mechanism of the intermediate transfer unit 240 will be supplemented for clarity.

In this example, as illustrated in FIG. 17, an intermediate transfer body retract mechanism 280 which retracts a flat surface portion of the intermediate transfer body 40 facing the photoconductor 32 and a primary transfer retract mechanism 290 which retracts the primary transfer device (for example, a primary transfer roller) 46 are used as the retract mechanism.

In this example, the intermediate transfer body retract mechanism 280 stretches the flat surface portion of the intermediate transfer body 40 with a fixed retract roller 281 and a movable retract roller 282 that is retractable, and moves the movable retract roller 282 from a retracted position to a contact position using a transmission gear 283 and a link arm 284, for example, in conjunction with the rotation of the gear handles 271 of the drive transmission shaft 270.

Further, the primary transfer retract mechanism 290 has slide plates 291 extending along the movement direction of the intermediate transfer body 40 so as to pass through both sides of each primary transfer device 46. The slide plates 291 are moved by, for example, the rotation of the cam handles 272 of the drive transmission shaft 270, and link arms 292 rotatably support the slide plates 291 and both end support portions of each primary transfer device 46. The primary transfer device 46 is set to a setting position where it comes into contact with the intermediate transfer body 40 as the slide plates 291 move in a predetermined direction.

In this way, in this example, the drive transmission shaft 270 rotates in conjunction with the rotational operation of the operation lever 181, and the retract mechanism (280 and 290) of the intermediate transfer unit 240 is actuated in conjunction with the rotation of the drive transmission shaft 270, so that the setting operation of the intermediate transfer unit 240 is performed.

Retaining Operation of Waste Developer Transport Unit

In this example, the waste developer transport unit 100 includes retaining mechanisms 300 on both sides in the width direction of the unit case 101. When the waste developer transport unit 100 is attached and the operation lever 181 of the locking mechanism 180 is moved to the rotation terminal position P2, retaining protrusions 301 and 302 protrude from both sidewalls of the unit case 101 and are caught by retaining recesses (not illustrated) formed in the receiving portion 21*a* of the apparatus housing 21.

In this example, the drive force may be transmitted from a part of the locking mechanism 180 to the drive transmission mechanism 310, so that the retaining protrusions 301 and 302 are moved by the transmitted drive force.

Here, as the drive transmission mechanism 310, for example, as illustrated in FIGS. 7, 10, 13, 15, and 18A and 18B, a transmission gear portion 311 is formed on a part of the outer peripheral wall of the shaft portion 183 of the operation lever 181 or the outer peripheral wall of the joining coupling 190, and a drive transmission gear train 312 meshes with the transmission gear portion 311. Also, a slidable guide plate 313 extends by a long length in a direction along the waste developer transport direction of the waste developer transport unit 100, and a rack 314 is provided on the guide plate 313 to mesh with a final gear of the drive transmission gear train 312. One retaining protrusion 301 is provided on one longitudinal end side of the guide plate 313. A rack 315 is provided on the other longitudinal end side of the guide plate 313. An eccentric cam 317 is provided coaxially with a transmission gear 316 which meshes with the rack 315, and the other retaining protrusion 302 protrudes at the eccentric cam 317.

According to this example, the guide plate 313 may be moved in a predetermined direction via the drive transmission mechanism 310 in conjunction with the rotational operation of the operation lever 181 to protrude one retaining protrusion 301 outward from the sidewall of the unit case 101, while the other retaining protrusion 302 may protrude outward from the sidewall of the unit case 101 by the rack 315, the transmission gear 316, and the eccentric cam 317.

Opening Operation of Opening and Closing Shutter at Each Connection Port of Waste Developer Transport Unit In this example, the locking mechanism 180 is adapted to use a rotational drive force associated with the rotational operation of the operation lever 181 for the opening operation of the opening and closing shutter 350 (see FIG. 7) at each connection port by using the drive transmission mechanism 310 described above.

Specifically, as illustrated in FIGS. 7, 10, 13, 15, and 18A and 18B, a rack 320 is appropriately formed near each connection port of the guide plate 313, while a transmission gear 321 that is coaxial with the opening and closing shutter 350 is provided on the opening and closing shutter 350 at each connection port to mesh with the rack 320 directly or via a pinion gear 322. As such, the guide plate 313 is moved by the rotational drive force of the operation lever 181, and the opening and closing shutter 350 is opened by using the movement span of the guide plate 313 and the transmission gear 321.

According to this example, after the waste developer transport unit 100 is attached, a general-purpose waste developer ducts on the apparatus body are inserted into the respective connection ports. In this state, since the opening and closing shutter 350 is opened by rotating (performing the rotational operation for) the operation lever 181, there is no risk of the waste developer being unnecessarily spilled to the outside of the waste developer transport unit 100.

Next, in order to evaluate the performance of the locking mechanism 180 of the waste developer transport unit 100 according to the present exemplary embodiment, a locking mechanism of a waste developer transport unit according to a first comparative example will be described by way of example.

First Comparative Example

Figure 19A:
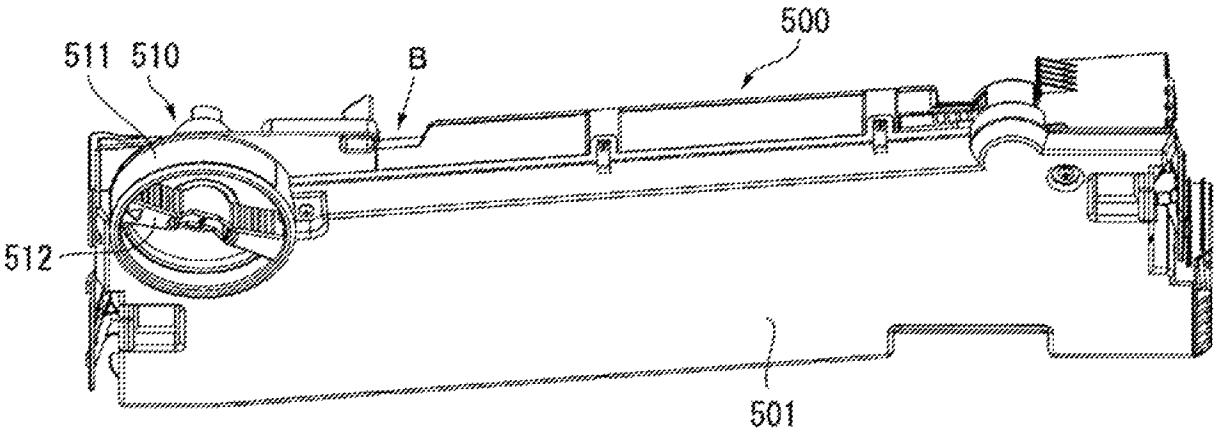
FIG. 19A RELATED ART
FIG. 19A is a view illustrating a part of a waste developer transport unit according to a first comparative example.
Figure 19B:
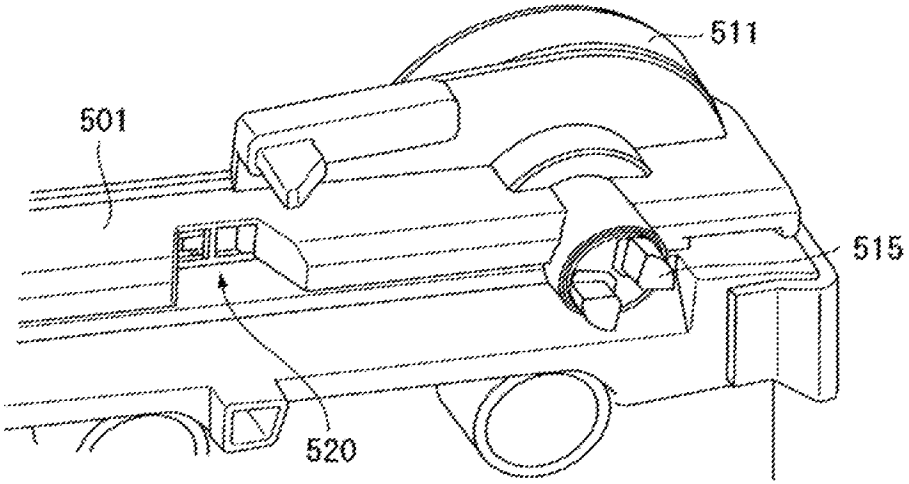
FIG. 19B RELATED ART
FIG. 19B is a view seen from a direction indicated by an arrow B in FIG. 19A.
Figure 20:
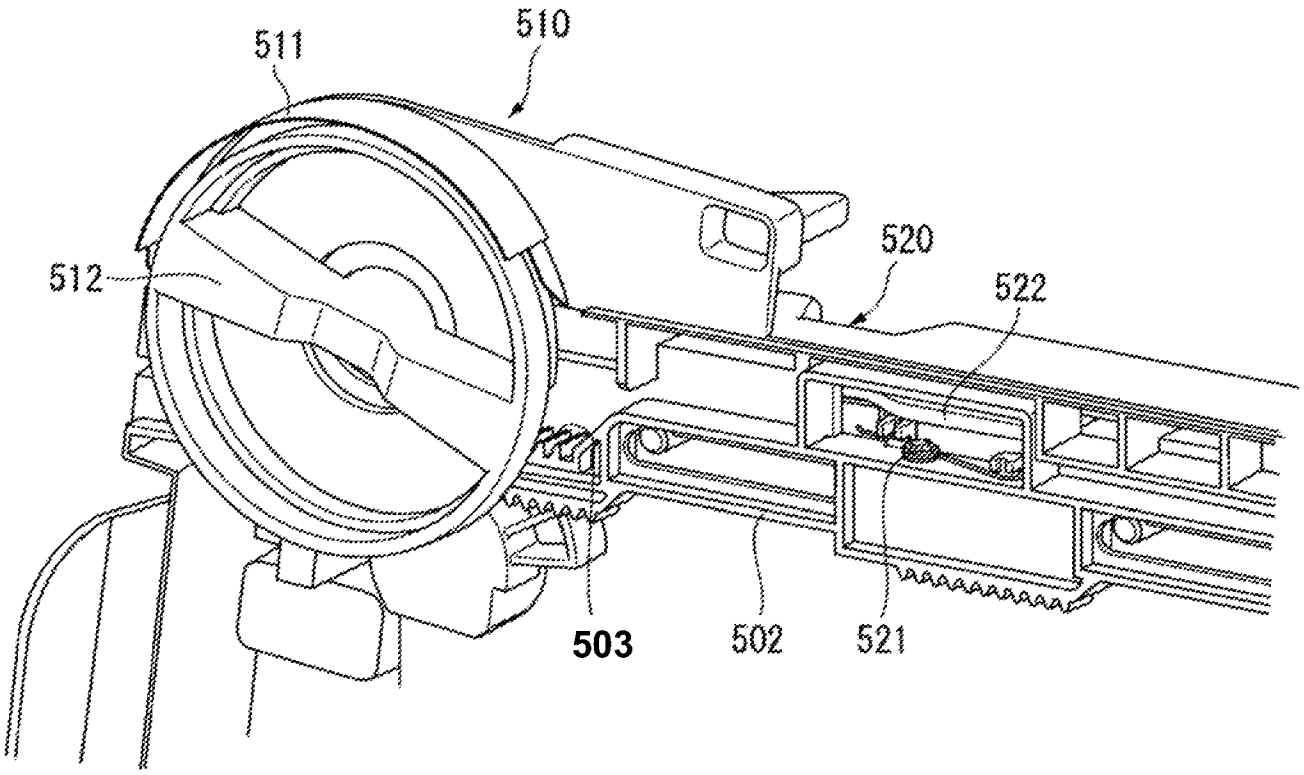
FIG. 20 RELATED ART
FIG. 20 is a view illustrating an exemplary configuration of a locking mechanism used in the first comparative example.

FIGS. 19A and 19B illustrate a waste developer transport unit 500 according to a first comparative example.

In FIGS. 19A and 19B, unlike the first exemplary embodiment, a locking mechanism 510 is provided with a handle 512 on a rotatable rotational operation plate 511, and a joining coupling 515 is provided on the back surface side of the rotational operation plate 511 so as to be joined with a joined coupling (not illustrated).

In this example, as illustrated in FIGS. 20 to 22B, in the peripheral structure of the rotational operation plate 511, an elongated guide plate 502 is slidably arranged along the transport direction of the waste developer in a unit case 501, and for example, a transmission gear 513 is provided coaxially with the rotational operation plate 511. Also, a rack 503 is provided on the guide plate 502 to mesh with the transmission gear 513, so that the guide plate 502 is moved according to the rotation of the rotational operation plate 511.

Meanwhile, a lock mechanism 520 is provided at a position offset from the rotation center of the rotational operation plate 511. The lock mechanism 520 of this example employs a manner in which it includes a stopper piece 522 which is urged onto the guide plate 502 by an urging spring 521, and the guide plate 502 is restrained by colliding the stopper piece 522 with a stopper wall 523 of the unit case 501, so that the rotation of the rotational operation plate 511 is prohibited (see FIG. 22A).

Figure 21:
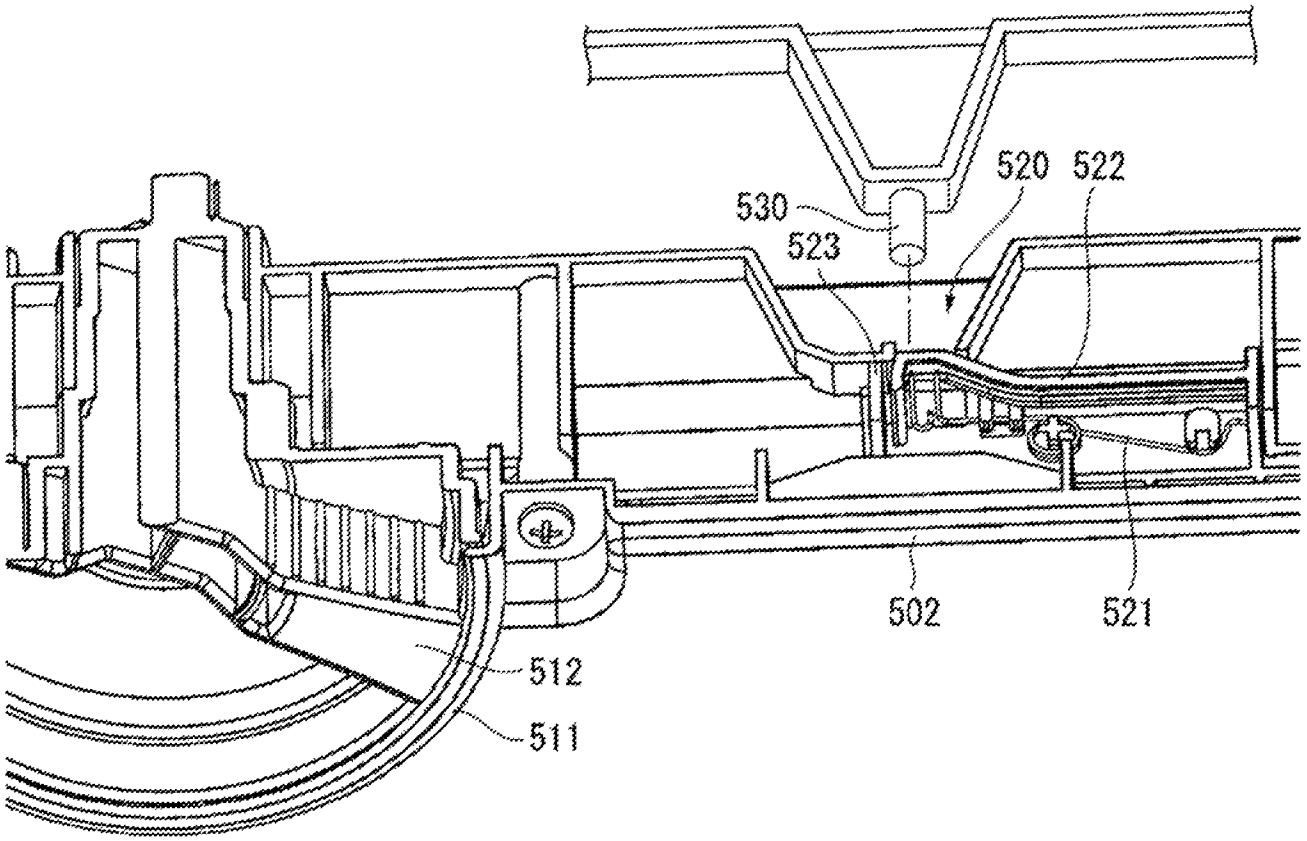
FIG. 21 RELATED ART
FIG. 21 is a view illustrating an exemplary operation when the locking mechanism used in the first comparative example is unlocked.
Figure 22A:
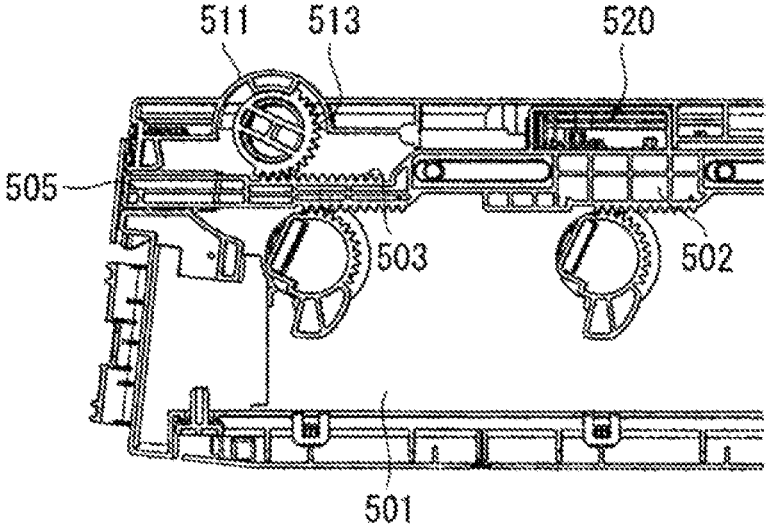
FIG. 22A RELATED ART
FIG. 22A is a view illustrating the locked state of the locking mechanism used in the first comparative example.
Figure 22B:
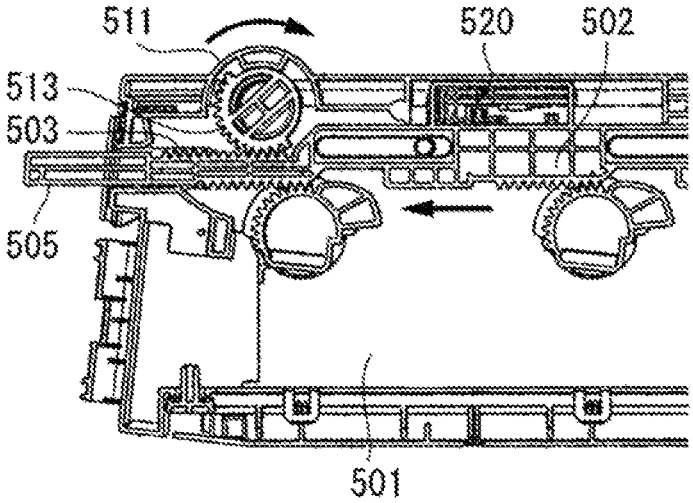
FIG. 22B RELATED ART
FIG. 22B is a view illustrating the unlocked state of the locking mechanism.

In this example, in a case where the rotational operation plate 511 is unlocked by the lock mechanism 520, as illustrated in FIG. 21, when a restraint release protrusion 530 is provided in advance on the apparatus housing 21 side and the waste developer transport unit 500 is attached, the stopper piece 522 and the stopper wall 523 are disengaged by the restraint release protrusion 530, causing the rotational operation plate 511 to be unlocked. In this case, as illustrated in FIG. 22B, with the rotational operation of the rotational operation plate 511, for example, a retaining protrusion 505 provided on the guide plate 502 protrudes outward from the sidewall of the unit case 501, which makes it possible to prevent the separation of the waste developer transport unit 500.

However, in this example, since the restraint position by the lock mechanism 520 is offset from the rotation center of the rotational operation plate 511, if the positions of the restraint release protrusion 530 and the stopper piece 522 accidentally match each other due to component tolerances or variations in positioning, there is a risk of the rotational operation plate 511 being erroneously unlocked in a situation where the joining coupling 515 and the joined coupling are not joined with each other.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A detachable container comprising:

a container body configured to be detachably attached to a receiving portion of an apparatus housing;

a joining unit provided on the container body, the joining unit being configured to be rotatably joined with a joined unit provided on the apparatus housing;

an operation unit having a rotation center coaxial with the joining unit, the operation unit being configured to perform a rotational operation for the joining unit; and a restraint unit provided coaxially with the rotation center of the operation unit, the restraint unit being configured to, when the container body is attached to the receiving portion of the apparatus housing, allow a rotation of the operation unit, and when the container body is not attached, to restrain the rotation of the operation unit.

2. The detachable container according to claim 1, wherein the restraint unit comprises a movable lock element configured to move from a restraint position where the movable lock element restrains the operation unit to a restraint release position where the movable lock element releases the operation unit from a restrained state, and a fixed lock element configured to restrain the operation unit in conjunction with the movable lock element at the restraint position.

3. The detachable container according to claim 2, wherein when the container body is attached, the restraint unit moves the movable lock element from the restraint position to the restraint release position in conjunction with a restraint release element provided coaxially with the joining unit or the joined unit.

4. The detachable container according to claim 3, wherein the restraint unit comprises an urging element configured to urge the movable lock element toward the restraint position, and when the container body is not attached, the restrain unit holds the movable lock element at the restraint position.

5. The detachable container according to claim 4, wherein the movable lock element moves forward and backward along a rotational axis of the operation unit, and the movable lock element is stopped from rotating by a rotation stop.

6. The detachable container according to claim 4, wherein the movable lock element comprises a moving element configured to move forward and backward along a rotational axis of the operation unit, and a protruding element that protrudes in a direction intersecting with a direction in which the moving element moves forward and backward, when the movable lock element is located at the restraint position, the protruding element is in contact with the fixed lock element, and when the movable lock element is located at the restraint release position, the protruding element is not in contact with the fixed lock element.

7. The detachable container according to claim 3, wherein the movable lock element moves forward and backward along a rotational axis of the operation unit, and the movable lock element is stopped from rotating by a rotation stop.

8. The detachable container according to claim 3, wherein the movable lock element comprises a moving element configured to move forward and backward along a rotational axis of the operation unit, and a protruding element that protrudes in a direction intersecting with a direction in which the moving element moves forward and backward, when the movable lock element is located at the restraint position, the protruding element is in contact with the fixed lock element, and when the movable lock element is located at the restraint release position, the protruding element is not in contact with the fixed lock element.

9. The detachable container according to claim 2, wherein the restraint unit comprises an urging element configured to urge the movable lock element toward the restraint position, and when the container body is not attached, the restrain unit holds the movable lock element at the restraint position.

10. The detachable container according to claim 9, wherein the movable lock element moves forward and backward along a rotational axis of the operation unit, and the movable lock element is stopped from rotating by a rotation stop.

11. The detachable container according to claim 9, wherein the movable lock element comprises a moving element configured to move forward and backward along a rotational axis of the operation unit, and a protruding element that protrudes in a direction intersecting with a direction in which the moving element moves forward and backward, when the movable lock element is located at the restraint position, the protruding element is in contact with the fixed lock element, and when the movable lock element is located at the restraint release position, the protruding element is not in contact with the fixed lock element.

12. The detachable container according to claim 2, wherein the movable lock element moves forward and backward along a rotational axis of the operation unit, and the movable lock element is stopped from rotating by a rotation stop.

13. The detachable container according to claim 12, wherein the movable lock element comprises a moving element configured to move forward and backward along the rotational axis of the operation unit, and a protruding element that protrudes in a direction intersecting with a direction in which the moving element moves forward and backward, when the movable lock element is located at the restraint position, the protruding element is in contact with the fixed lock element, and when the movable lock element is located at the restraint release position, the protruding element is not in contact with the fixed lock element.

14. The detachable container according to claim 12, wherein the movable lock element comprises a moving element configured to move forward and backward along the rotational axis of the operation unit, and a protruding element that protrudes in a direction intersecting a direction in which the moving element moves forward and backward, and the protruding element is stopped from rotating by the rotation stop.

15. The detachable container according to claim 2, wherein the movable lock element comprises a moving element configured to move forward and backward along a rotational axis of the operation unit, and a protruding element that protrudes in a direction intersecting with a direction in which the moving element moves forward and backward, when the movable lock element is located at the restraint position, the protruding element is in contact with the fixed lock element, and when the movable lock element is located at the restraint release position, the protruding element is not in contact with the fixed lock element.

16. The detachable container according to claim 2, wherein a drive transmission portion is formed on a shaft portion of the operation unit or an outer peripheral portion of the joining unit, the detachable container further comprising a drive transmission unit configured to transmit a rotational drive force from the drive transmission portion to a transmission target element in conjunction with the rotational operation of the operation unit.

17. The detachable container according to claim 16, wherein the container body has a connection opening to which a transport unit provided on the apparatus housing is connectable, the transmission target element comprises an opening and closing unit configured to open and close the connection opening, and when the container body is attached, the drive transmission unit opens the opening and closing unit in conjunction with the rotational operation of the operation unit.

18. The detachable container according to claim 16, wherein the transmission target element comprises a retaining unit configured to, when the container body is attached, hold the container body inseparably with respect to the receiving portion of the apparatus housing, and when the container body is attached, the drive transmission unit actuates the retaining unit in conjunction with the rotational operation of the operation unit.

19. A container mounting apparatus comprising:

an apparatus housing comprising a rotatable joined unit; and the detachable container according to claim 1, the detachable container being configured to be detachably attached to the receiving portion of the apparatus housing.

20. The container mounting apparatus according to claim 19, wherein the joined unit constitutes a drive input unit of a forward and backward movement mechanism that moves a movable element forward and backward.

* * * * *